US011231737B2

(12) United States Patent
Asano

(10) Patent No.: US 11,231,737 B2
(45) Date of Patent: Jan. 25, 2022

(54) LINKING STRUCTURE OF OPERATION LEVER, AND INPUT DEVICE INCLUDING THE LINKING STRUCTURE

(71) Applicant: HOSIDEN CORPORATION, Yao (JP)

(72) Inventor: Mitsuhiro Asano, Yao (JP)

(73) Assignee: Hosiden Corporation, Yao (JP)

( * ) Notice: Subject to any disclaimer, the term of this patent is extended or adjusted under 35 U.S.C. 154(b) by 0 days.

(21) Appl. No.: 17/145,596

(22) Filed: Jan. 11, 2021

(65) Prior Publication Data

US 2021/0247795 A1 Aug. 12, 2021

(30) Foreign Application Priority Data

Feb. 12, 2020 (JP) ..... JP2020-021259

(51) Int. Cl.
*G05G 1/04* (2006.01)
*G05G 5/05* (2006.01)

(52) U.S. Cl.
CPC ..... *G05G 1/04* (2013.01); *G05G 5/05* (2013.01); *G05G 2505/00* (2013.01)

(58) Field of Classification Search
CPC ..... G05G 5/05; G05G 2505/00
See application file for complete search history.

(56) References Cited

U.S. PATENT DOCUMENTS 6,654,005 B2 * 11/2003 Wang ..... G05G 9/04796 200/6 A
10,770,247 B1 * 9/2020 Wu ..... H01H 23/143
2006/0279544 A1 * 12/2006 Huang ..... G05G 9/04796 345/161
2018/0059710 A1 * 3/2018 Wu ..... G05G 9/047
2018/0190452 A1 * 7/2018 Wu ..... H01H 25/065

FOREIGN PATENT DOCUMENTS

CN 204332792 U 5/2015
JP 2004-164423 A 6/2004

OTHER PUBLICATIONS

Extended European Search Report for European Patent Application No. 21153242.9, dated Jul. 21, 2021 (9 pages).

* cited by examiner

*Primary Examiner* — Vicky A Johnson
(74) *Attorney, Agent, or Firm* — Kilyk & Bowersox, P.L.L.C.

(57) ABSTRACT

A linking structure including an interlocking member pivotable in a second direction, and a lever tiltably linked to the interlocking member. The interlocking member includes a blind elongated hole extending in a first direction; first to fourth edges of the elongated hole; a bottom closing the elongated hole and being contiguous with the edges; and first and second shaft holes in the first and second edges to extend communicatingly from the elongated hole to opposite sides in the second direction. The lever includes a base in the elongated hole; first and second juts extending from the base, being swingably received in the elongated hole, and being in abutment with, or opposed with a narrow clearance to, the first and second edges; and first and second rotation shafts extending from the base and being supported in the first and second shaft holes such as to be rotatable in the first direction.

20 Claims, 10 Drawing Sheets

LINKING STRUCTURE OF OPERATION LEVER, AND INPUT DEVICE INCLUDING THE LINKING STRUCTURE

CROSS-REFERENCE TO RELATED APPLICATION

The present application claims priority under 35 U.S.C. § 119 of Japanese Patent Application No. 2020-021259 filed on Feb. 12, 2020, the disclosure of which is expressly incorporated by reference herein in its entirety.

BACKGROUND OF THE INVENTION

Technical Field

The invention relates to linking structures for operation levers and also relates to input devices including the linking structures.

Background Art

Japanese Unexamined Patent Application Publication No. 2004-164423 discloses a conventional input device. The input device includes first and second interlocking members, a base, and an operation lever. The first interlocking member extends in a first direction. The first interlocking member includes a main body with a first elongated hole and first and second shaft holes. The first elongated hole is a through hole extending in the first direction through the main body of the first interlocking member. The first and second shaft holes, cylindrical holes in inner walls of the first elongated hole on opposite sides in a second direction substantially orthogonal to the first direction, extend to one and the other sides in the second direction. The second interlocking member extends in the second direction to be arranged substantially orthogonally to, and above, the first interlocking member. The second interlocking member includes a main body with a second elongated hole. The second elongated hole is a through hole extending in the second direction through the main body of the second interlocking member. The base is arranged below the first interlocking member and has a spherical concave support. The operation lever includes a lever body, first and second rotation shafts, and first and second bulging portions. The lever body extends through the first and second elongated holes of the first and second interlocking members and is slidably supported by the support of the base. The first and second rotation shafts are cylinders extending from the lever body to one and the other sides in the second direction and being rotatably supported in the first and second shaft holes of the first interlocking member. The first and second bulging portions bulge from the lever main body to one and the other sides in the first direction and fit in the first elongated hole. The first and second bulging portions each have opposite faces in the second direction, which are in sliding contact with opposite inner faces of the first elongated hole.

SUMMARY OF INVENTION

The main body of the first interlocking member has a low rigidity because it is provided with the first elongated hole, which is a through hole, and has a generally frame-like shape in plan view. When the operation lever is twisted in a circumferential direction, one of the first and second bulging portions of the operation lever presses, from the other side in the second direction, a first edge on one side in the second direction of the first elongated hole of the main body of the first interlocking member, and the other one of the first the second bulging portions presses, from the one side in the second direction, a second edge on the other side in the second direction of the first elongated hole of the main body of the first interlocking member, which may result in distortion of the main body of the first interlocking member. Therefore, the conventional input device has a low strength to the twisting of the operation lever in the circumferential direction.

The invention provides a linking structure of an operation lever improving the strength of the operation lever being twisted in a circumferential direction. The invention also provides an input device including the linking structure.

The linking structure of an operation lever according to an aspect of the invention includes a first interlocking member and an operation lever.

The first interlocking member extends in a first direction and is pivotable in a second direction crossing the first direction. The first interlocking member includes a first elongated hole, a first edge of the first elongated hole on one side in the second direction, a second edge of the first elongated hole on the other side in the second direction, a third edge of the first elongated hole on one side in the first direction, a fourth edge of the first elongated hole on the other side in the first direction, a bottom, a first shaft hole, and a second shaft hole. The first elongated hole is a blind hole extending in the first direction and opening to one side in a third direction. The third direction is substantially orthogonal to the first and second directions. The bottom of the first interlocking member closes the first elongated hole on the other side in the third direction and is contiguous with the first, second, third, and fourth edges. The first shaft hole is provided in the first edge, extends from the first elongated hole to the one side in the second direction, and communicates with the first elongated hole. The second shaft hole is provided in the second edge, extends from the first elongated hole to the other side in the second direction, and communicates with the first elongated hole.

The operation lever is linked to the first interlocking member such as to be tiltable in the first direction, and is configured to tilt in the second direction and to thereby pivot the first interlocking member to the same direction as the tilt of the operation lever. The operation lever includes a base provided on one side in an axial direction of the operation lever, a first jut, a second jut, a first rotation shaft, and a second rotation shaft. The base is received in the first elongated hole. The first jut extends from the base to the one side in the first direction. The second jut extends from the base to the other side in the first direction. The first and second juts are swingably received in the first elongated hole. The first and second juts are in abutment with, or alternatively opposed with a narrow clearance to, the first and second edges. The first rotation shaft extends from the base to the one side in the second direction and is supported in the first shaft hole such as to be rotatable in the first direction. The second rotation shaft extends from the base to the other side in the second direction and is supported in the second shaft hole such as to be rotatable in the first direction.

The linking structure of this aspect imparts improved strength to the operation lever being twisted in the circumferential direction for the following reason. Since the first elongated hole of the first interlocking member is a blind hole closed on the other side in the third direction with the bottom contiguous with the first, second, third, and fourth edges, the first interlocking member will resist distortion when the operation lever is twisted in the circumferential direction such that the first jut presses one of the first and second edges of the first elongated hole of the first interlocking member, and such that the second jut presses the other of the first and second edges.

The base may be in abutment with, or alternatively being opposed with a narrow clearance to, the first and second edges.

The bottom of the first interlocking member may include a bottom face of the first elongated hole. In this case, the operation lever may further include a swingable portion. The swingable portion may be provided on the base and project to the one side in the axial direction, or alternatively may be provided on the base, the first jut, and the second jut and project to the one side in the axial direction. In either case, the swingable portion may be swingably received in the first elongated hole and may slidably abut the bottom face of the first elongated hole. The swingable portion may be in abutment with, or opposed with a narrow clearance to, the first and second edges.

The first shaft hole of the first interlocking member may include a first recess. The first recess may be provided in the first edge, extend from the first elongated hole to the one side in the second direction, communicate with the first elongated hole, and open to the one side in the third direction. The second shaft hole of the first interlocking member may include a second recess. The second recess may be provided in the second edge, extend from the first elongated hole to the other side in the second direction, communicate with the first elongated hole, and open to the one side in the third direction.

The first rotation shaft may include a first portion on the other side in the second direction and a second portion on the one side in the second-direction side relative to the first portion of the first rotation shaft. The first portion, or the first portion and the second portion, of the first rotation shaft may be rotatably supported in the first recess. The second rotation shaft may include a first portion on the one side in the second direction and a second portion on the other side in the second-direction side relative to the first portion of the second rotation shaft. The first portion of the second rotation shaft, or the first portion and the second portion, of the second rotation shaft may be rotatably supported in the second recess.

The operation lever may further include a core. The core may extend in the axial direction of the operation lever and include the base.

The operation lever may further include at least one ridge. The at least one ridge may include at least one of a first ridge, a second ridge, a third ridge, or a fourth ridge. The first ridge may extend from the first jut to the other side in the axial direction and may also extend from the core to the one side in the first direction. The second ridge may extend from the second jut to the other side in the axial direction and may also extend from the core to the other side in the first direction. The third ridge may extend from the first portion, or the first portion and the second portion, of the first rotation shaft to the other side in the axial direction and may also extend from the core to the one side in the second direction. The fourth ridge may extend from the first portion, or the first portion and the second portion, of the second rotation shaft to the other side in the axial direction and may also extend from the core to the other side in the second direction.

The at least one ridge may include at least one set of two adjacent ridges. The at least one set may be at least one of the following sets: a set consisting of the first and third ridges adjacent to each other, a set consisting of the third and second ridges adjacent to each other, a set consisting of the second and fourth ridges adjacent to each other, or a set consisting of the fourth and first ridges adjacent to each other.

The operation lever may further include at least one reinforcing portion. The or each reinforcing portion may be suspended between the two adjacent ridges of the or a corresponding set and located on the other side in the axial direction relative to the first interlocking member with a clearance therebetween.

The first shaft hole of the first interlocking member may further include a first lateral hole. The first lateral hole may extend from the first recess to the one side in the second direction and communicate with the first recess. The second shaft hole of the first interlocking member may further include a second lateral hole. The second lateral hole may extend from the second recess to the other side in the second direction and communicate with the second recess. Where such first and second lateral holes are provided, the first portion of the first rotation shaft may be rotatably supported in the first recess, and the second portion of the first rotation shaft may be rotatably supported in the first lateral hole, the first portion of the second rotation shaft may be rotatably supported in the second recess, and the second portion of the second rotation shaft may be rotatably supported in the second lateral hole. The first interlocking member may further include a first shaft supporting arm and a second shaft supporting arm. The first shaft supporting arm may be an edge portion of the first lateral hole and may abut the second portion of the first rotation shaft from the one side in the third direction. The second shaft supporting arm may be an edge portion of the second lateral hole and may abut the second portion of the second rotation shaft from the one side in the third direction.

The first recess and the second recess can be omitted. In this case, the first lateral hole may be provided in the first edge, extend from the first elongated hole to the one side in the second direction, and communicate with the first elongated hole, and the second lateral hole may be provided in the second edge, extend from the first elongated hole to the other side in the second direction, and communicate with the first elongated hole. In this case, the first rotation shaft may be rotatably supported in the first lateral hole, and the second rotation shaft may be rotatably supported in the second lateral hole. The first shaft supporting arm of the first interlocking member may be an edge portion of the first lateral hole and may abut the first rotation shaft from the one side in the third direction. The second shaft supporting arm of the first interlocking member may be an edge portion of the second lateral hole and may abut the second rotation shaft from the one side in the third direction.

The first shaft supporting arm may be elastically deformable to the one side in the second direction until the first shaft supporting arm is released from the abutment against the first rotation shaft. The second shaft supporting arm may be elastically deformable to the other side in the second direction until the second shaft supporting arm is released from the abutment against the second rotation shaft.

The linking structure according to any of the above aspects may further include a second interlocking member intersecting the first interlocking member on the one side in the third direction relative to the first interlocking member.

The second interlocking member may include a second elongated hole extending through the second interlocking member in the third direction and extending in the second direction, a first edge of the second elongated hole on the one side in the first direction, a second edge of the second elongated hole on the other side in the first direction, a third edge of the second elongated hole on the one side in the second direction, and a fourth edge of the second elongated hole on the other side in the second direction. In this case, the operation lever may pass through the second elongated hole such as to be tiltable in the second direction inside the second elongated hole. Further, the operation lever may slidably abut the first edge and the second edge of the second elongated hole, or alternatively may be opposed with a narrow interstice to, and abuttable against, the first and second edges of the second elongated hole.

The second interlocking member may further include a first guide and a second guide. The first guide may be provided on the third edge of the second elongated hole and located on a first oblique direction side, or on the one side in the second direction, relative to the first shaft supporting arm. The first oblique direction may include components on the one side in the second direction and the one side in the third direction. The first shaft supporting arm may be swingably guided in the second direction by the first guide. The second guide may be provided on the fourth edge of the second elongated hole and located on a second oblique direction side, or on the other side in the second direction, relative to the second shaft supporting arm. The second oblique direction may include components on the other side in the second direction and the one side in the third direction. The second shaft supporting arm may be swingably guided in the second direction by the second guide.

Where the operation lever includes the first, second, third, and fourth ridges, the third edge of the second elongated hole may include a first protrusion protruding toward a gap between the first ridge and the third ridge, and a second protrusion protruding toward a gap between the third ridge and the second ridge, and the fourth edge of the second elongated hole may include a third protrusion protruding toward a gap between the second ridge and the fourth ridge, and a fourth protrusion protruding toward a gap between the fourth ridge and the first ridge.

An input device according to an aspect of the invention may include: the linking structure of an operation lever according to any of the above aspects; a pair of first supports; a first detector; and a second detector. The first interlocking member may further include a main body and a pair of pivot shafts. The pivot shafts may extend from the main body respectively to the one and the other sides in the first direction and may be rotatably supported by the corresponding first supports. The main body of the first interlocking member may include the first elongated hole, the first edge of the first elongated hole, the second edge of the first elongated hole, the third edge of the first elongated hole, the fourth edge of the first elongated hole, the bottom, the first shaft hole, and the second shaft hole described above. In this case, the operation lever may be configured to tilt in the first direction with the first and second rotation shafts serving as a pivot, the operation lever may be configured to tilt in the second direction together with the first interlocking member, with the pivot shafts of the first interlocking member serving as a pivot, to cause the first interlocking member to pivot with the pivot shafts serving as a pivot.

Where the linking structure of an operation lever described above includes the second interlocking member, the input device may further include a pair of second supports. The second interlocking member may further include a main body and a pair of pivot shafts. The pivot shafts of the second interlocking member may extend from the main body the second interlocking member respectively to the one and the other sides in the second direction and may be rotatably supported by the corresponding second supports. The main body of the second interlocking member may include the second elongated hole, the first edge of the second elongated hole, the second edge of the second elongated hole, the third edge of the second elongated hole, and the fourth edge of the second elongated hole. In this case, the operation lever may be configured to tilt in the first direction with the first and second rotation shafts serving as a pivot and press the first or second edge of the second interlocking member, to cause the second interlocking member to pivot with the pivot shafts of the second interlocking member serving as the pivot, and the operation lever may be configured to tilt in the second direction together with the first interlocking member, with the pivot shafts of the first interlocking member serving as a pivot, to cause the first interlocking member to pivot with the pivot shafts of the first interlocking member serving as a pivot. The main body of the first interlocking member may further include the first shaft supporting arm and the second shaft supporting arm of any of the above aspects. The main body of the second interlocking member may further include the first guide and the second guide.

In the input device of any of the above aspects, the first detector may be configured to detect a tilt of the operation lever in the first direction, and the second detector may be configured to detect a tilt of the operation lever in the second direction.

Figure 1:
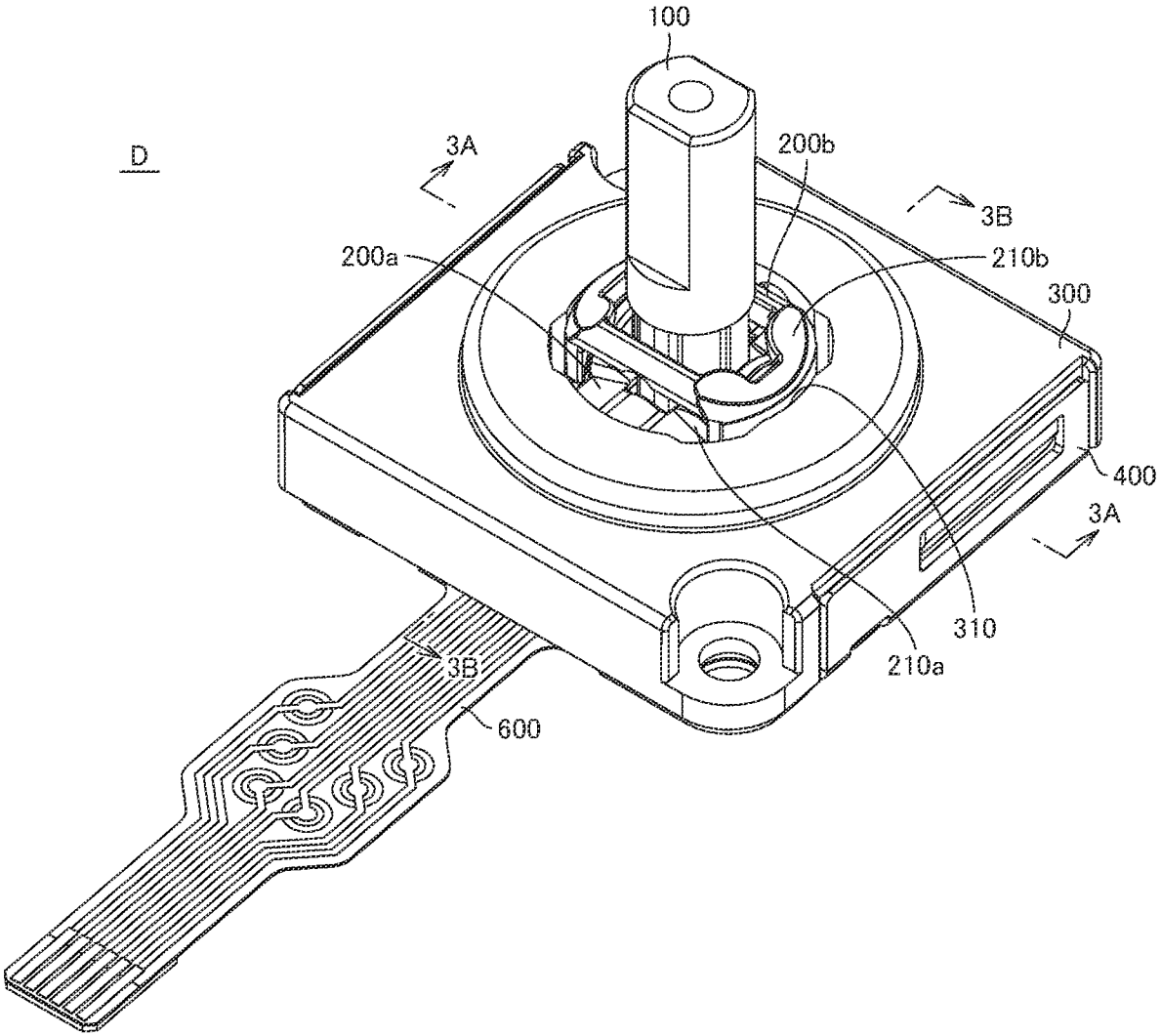
FIG. 1 is a front, top, right side perspective view of an input device according to a first embodiment of the invention.
Figure 2A:
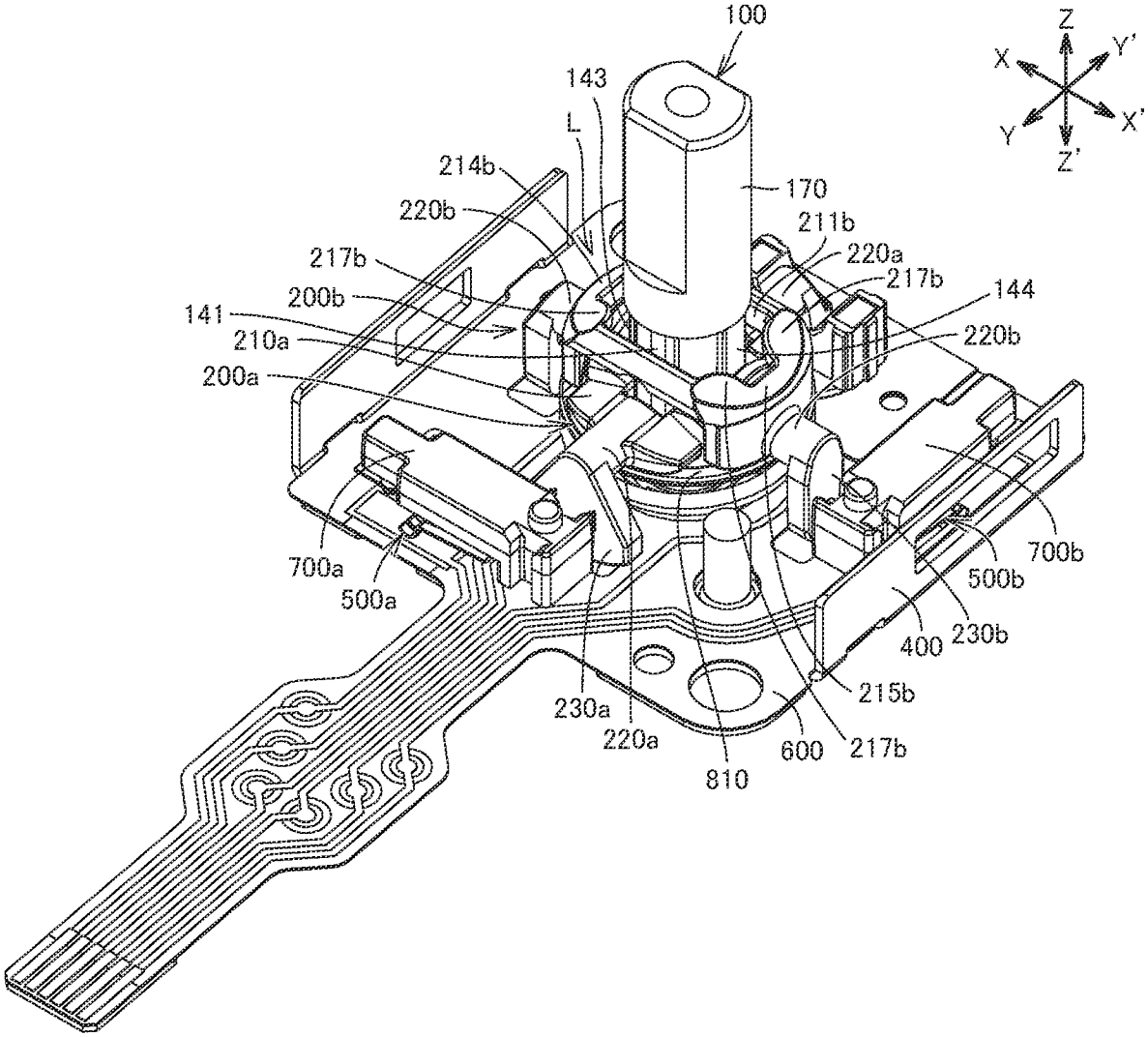
FIG. 2A is a front, top, right side perspective view of the input device with a housing thereof removed.
Figure 2B:
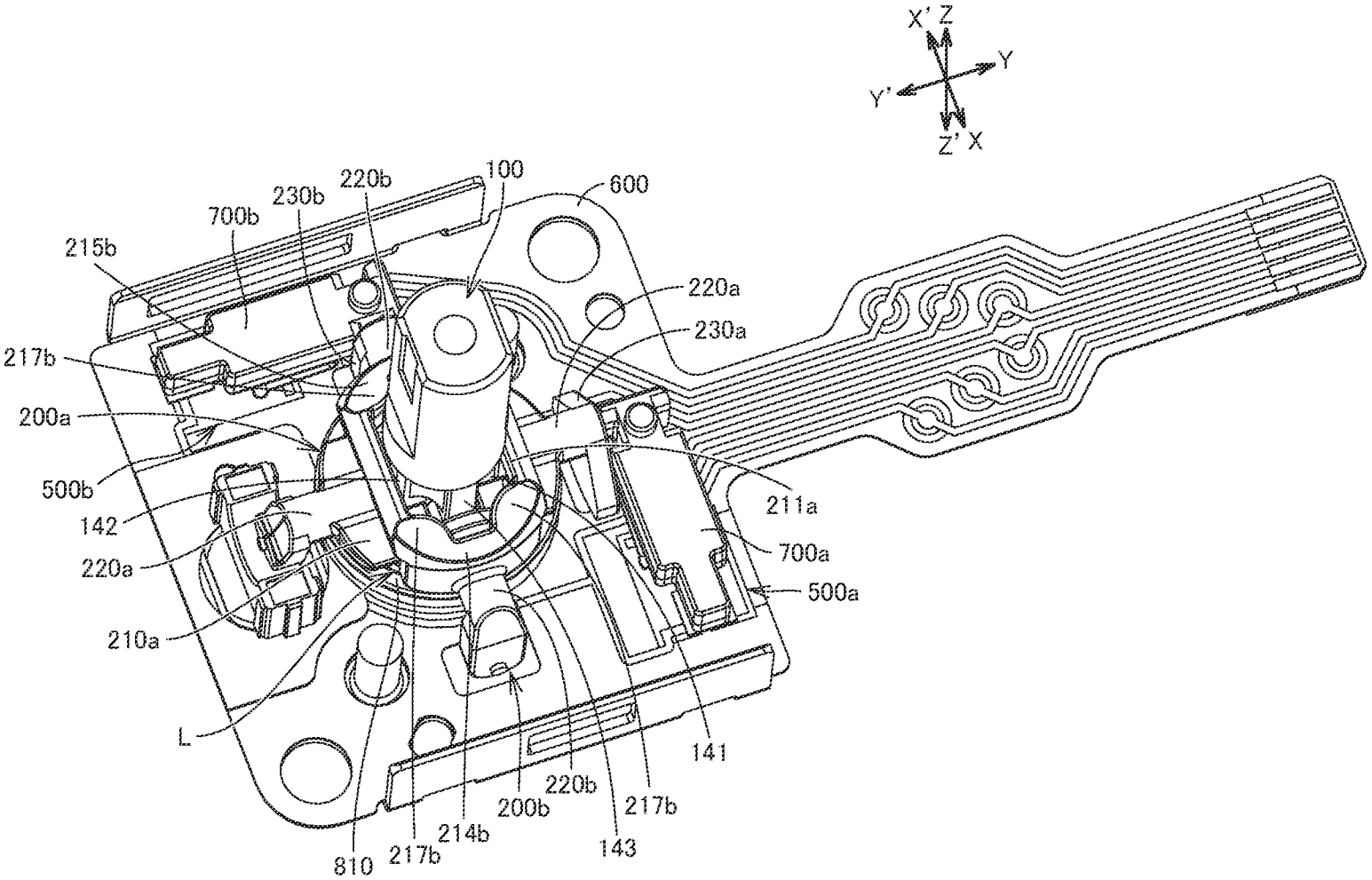
FIG. 2B is a rear, top, left side perspective view of the input device with the housing removed.

In the brief description of the drawings above and the description of embodiments which follows, relative spatial terms such as "upper", "lower", "top", "bottom", "left", "right", "front", "rear", etc., are used for the convenience of the skilled reader and refer to the orientation of the linking structures for operation levers and the input devices and their constituent parts as depicted in the drawings. No limitation is intended by use of these terms, either in use of the invention, during its manufacture, shipment, custody, or sale, or during assembly of its constituent parts or when incorporated into or combined with other apparatus.

DESCRIPTION OF EMBODIMENTS

Various embodiments of the invention, including a first embodiment and modifications thereof, will now be described. Elements of the embodiments and the modifications thereto to be described may be combined in any possible manner. Materials, shapes, dimensions, numbers, arrangements, etc. of the constituents of the various aspects of the embodiments and the modifications thereof will be discussed below as examples only and may be modified as long as they achieve similar functions.

First Embodiment

Figure 6:
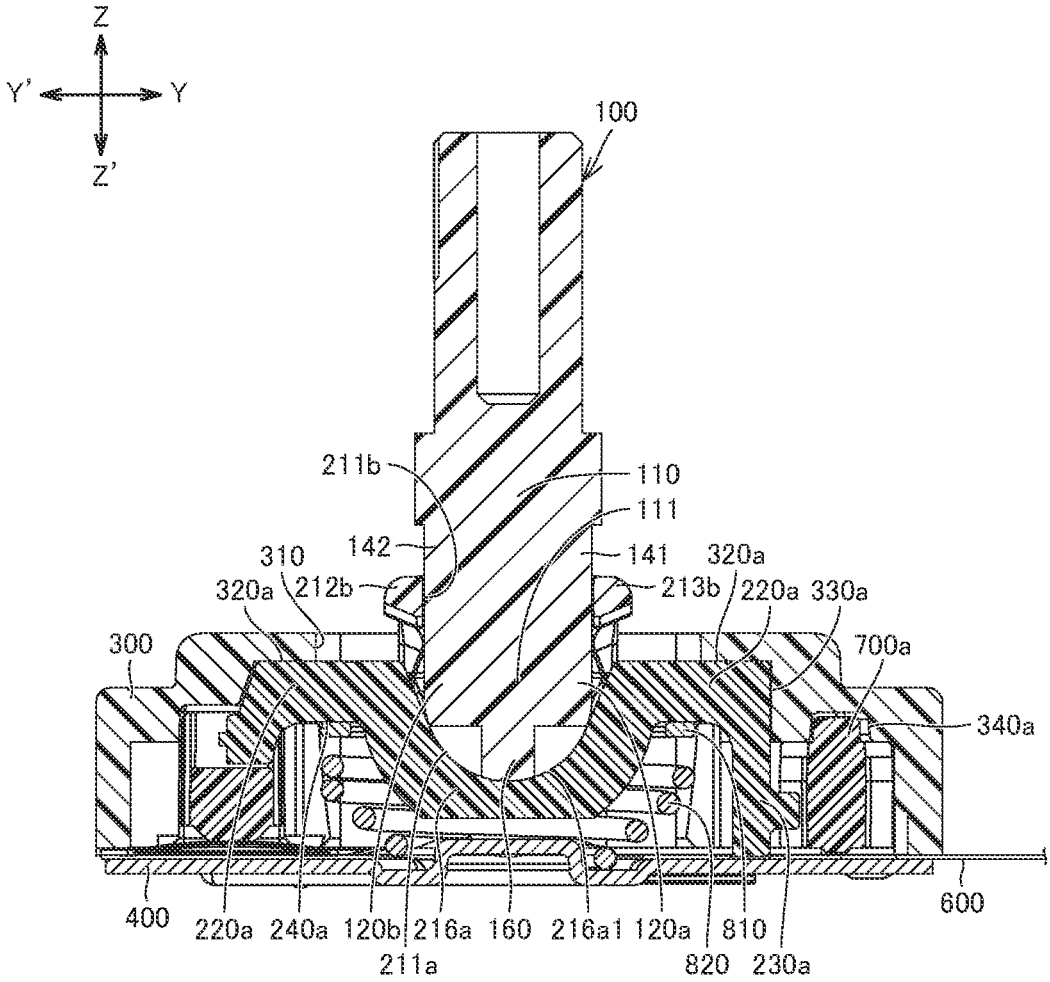
FIG. 6 is a cross-sectional view, corresponding to FIG. 3B, of a first variant of the input device.

Hereinafter described is an input device D according to a plurality of embodiments, including a first embodiment, of the invention and modifications thereof, with reference to FIGS. 1 to 6. FIGS. 1 to 5B show the input device D of the first embodiment. FIG. 6 shows a first variant of the input device D of the first embodiment. FIGS. 2A to 3A and 3C show a Y-Y' direction (first direction). The Y-Y' direction includes a Y direction (one side in the first direction) and a Y' direction (the other side in the first direction). FIGS. 2A, 2B, and 3B to 4B show an X-X' direction (second direction). The X-X' direction crosses the Y-Y' direction and may be substantially orthogonal to the Y-Y' direction as shown in FIGS. 2A, 2B, and 3B to 4B. The X-X' direction includes an X direction (one side in the second direction) and an X' direction (the other side in the second direction). FIGS. 2A to 4B show a Z-Z' direction (third direction). The Z-Z' direction is substantially orthogonal to the Y-Y' and X-X' directions. The Z-Z' direction includes a Z direction (one side in the third direction) and a Z' direction (the other side in the third direction).

The input device D includes a linking structure L (assembly) of an operation lever 100 and a first interlocking member 200*a*. The linking structure L includes the operation lever 100 and the first interlocking member 200*a* (which may be hereinafter referred to simply as an interlocking member 200*a*). The operation lever 100 is linked to the interlocking member 200*a* so as to be tiltable in the Y-Y' direction (in the Y and Y' directions), and is configured to tilt in the X-X' direction (in the X and X' directions) and to thereby pivot the interlocking member 200*a* in the same direction.

The operation lever 100 includes a base 111 on one side in the axial direction of the operation lever 100, a first jut 120*a*, a second jut 120*b*, a first rotation shaft 130*a*, and a second rotation shaft 130*b*.

The first jut 120*a* extends from the base 111 in the Y direction, and the second jut 120*b* extends from the base 111 in the Y' direction. The base 111, the first jut 120*a*, and the second jut 120*b* may preferably, but is not required to, have substantially the same width dimension. For example, the first jut 120*a* and the second jut 120*b* may have substantially the same width dimension, while the base 111 may have a width dimension that is smaller than that of the first jut 120*a* and the second jut 120*b*.

The first rotation shaft 130*a* is a cylinder, or alternatively a polygonal prism that approximates to a cylinder, extending in the X direction from the base 111. The second rotation shaft 130*b* is a cylinder, or alternatively a polygonal prism that approximates to a cylinder, extending in the X' direction from the base 111. As used herein a phrase "shape A that approximates to shape B" means that shape A looks like shape B when simplified with the details of shape A disregarded. The operation lever 100 is tiltable in the Y and Y' directions from the neutral position, with the first rotation shaft 130*a* and the second rotation shaft 130*b* serving as the pivot. The neutral position of the operation lever 100 may be a position where the axial direction of the operation lever 100 coincides with the Z-Z' direction (see FIGS. 1 to 3B and 6), or may be a position where the axial direction of the operation lever 100 is at an angle to the Z-Z' direction (not shown).

Figure 3A:
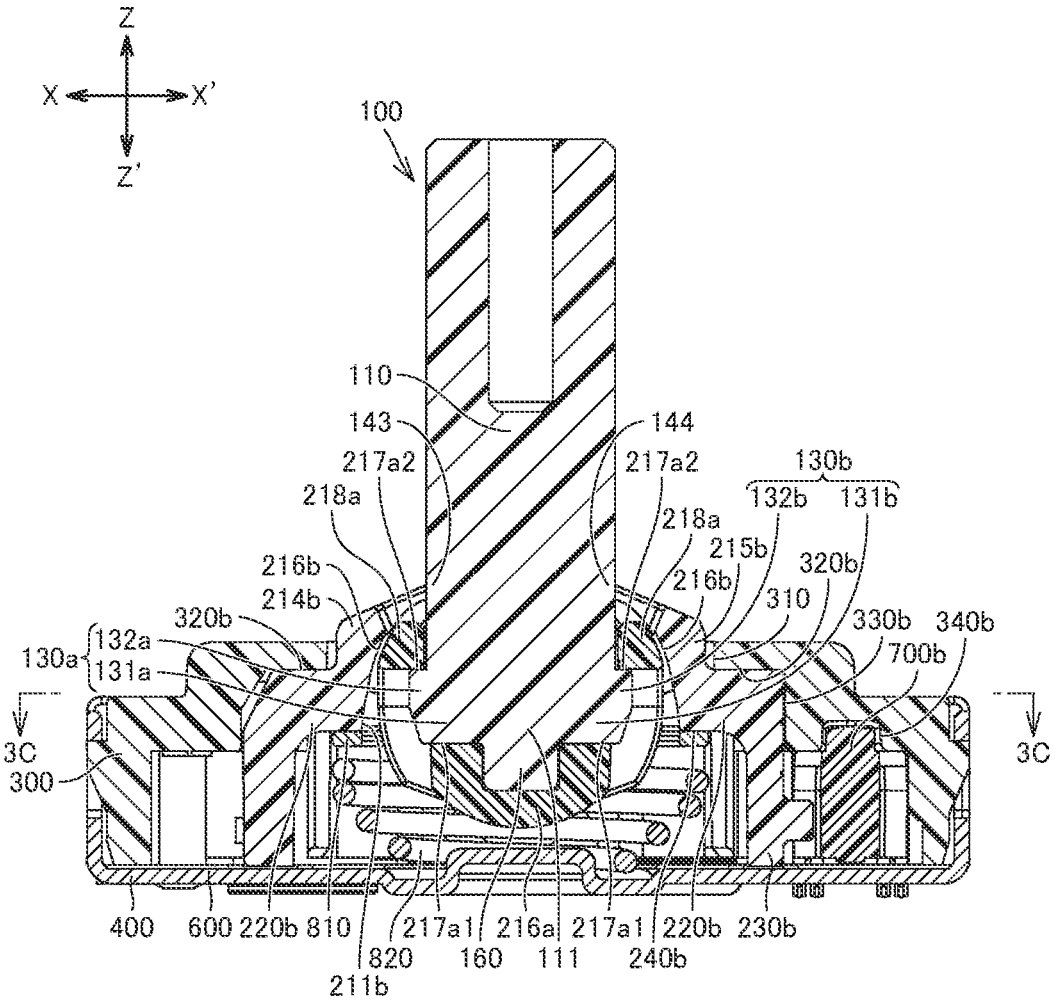
FIG. 3A is a cross-sectional view of the input device, taken along line 3A-3A in FIG. 1.
Figure 3B:
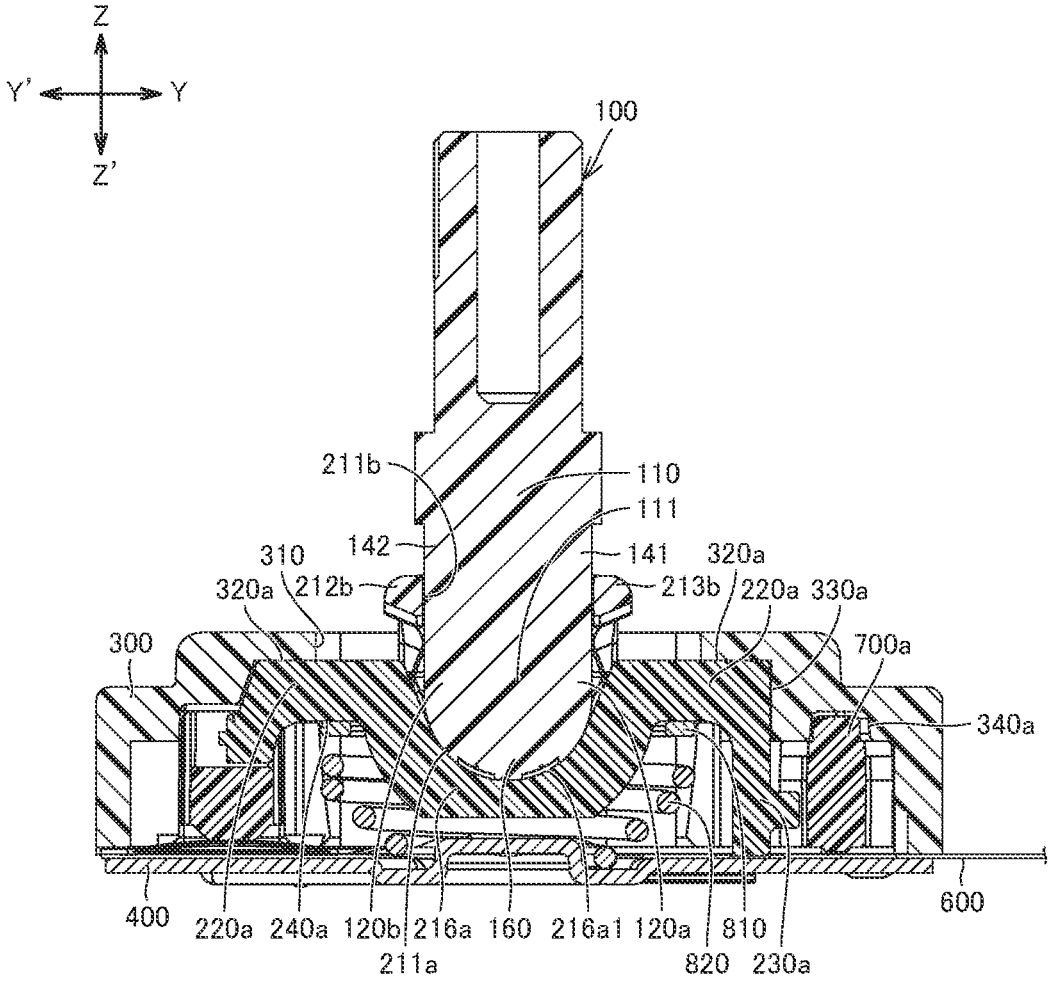
FIG. 3B is a cross-sectional view of the input device, taken along line 3B-3B in FIG. 1.
Figure 3C:
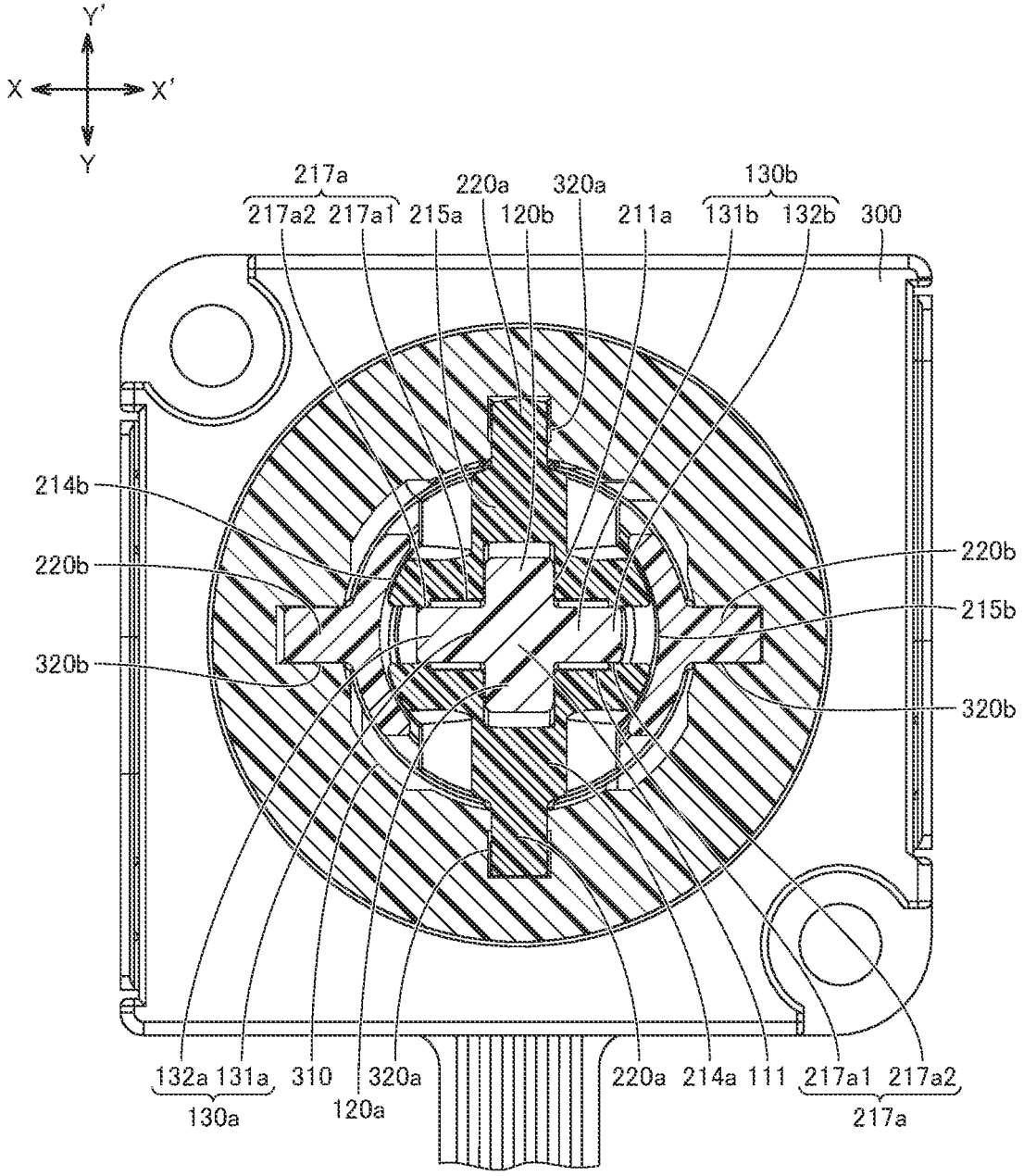
FIG. 3C is a cross-sectional view of the input device, taken along line 3C-3C in FIG. 3A.
Figure 4A:
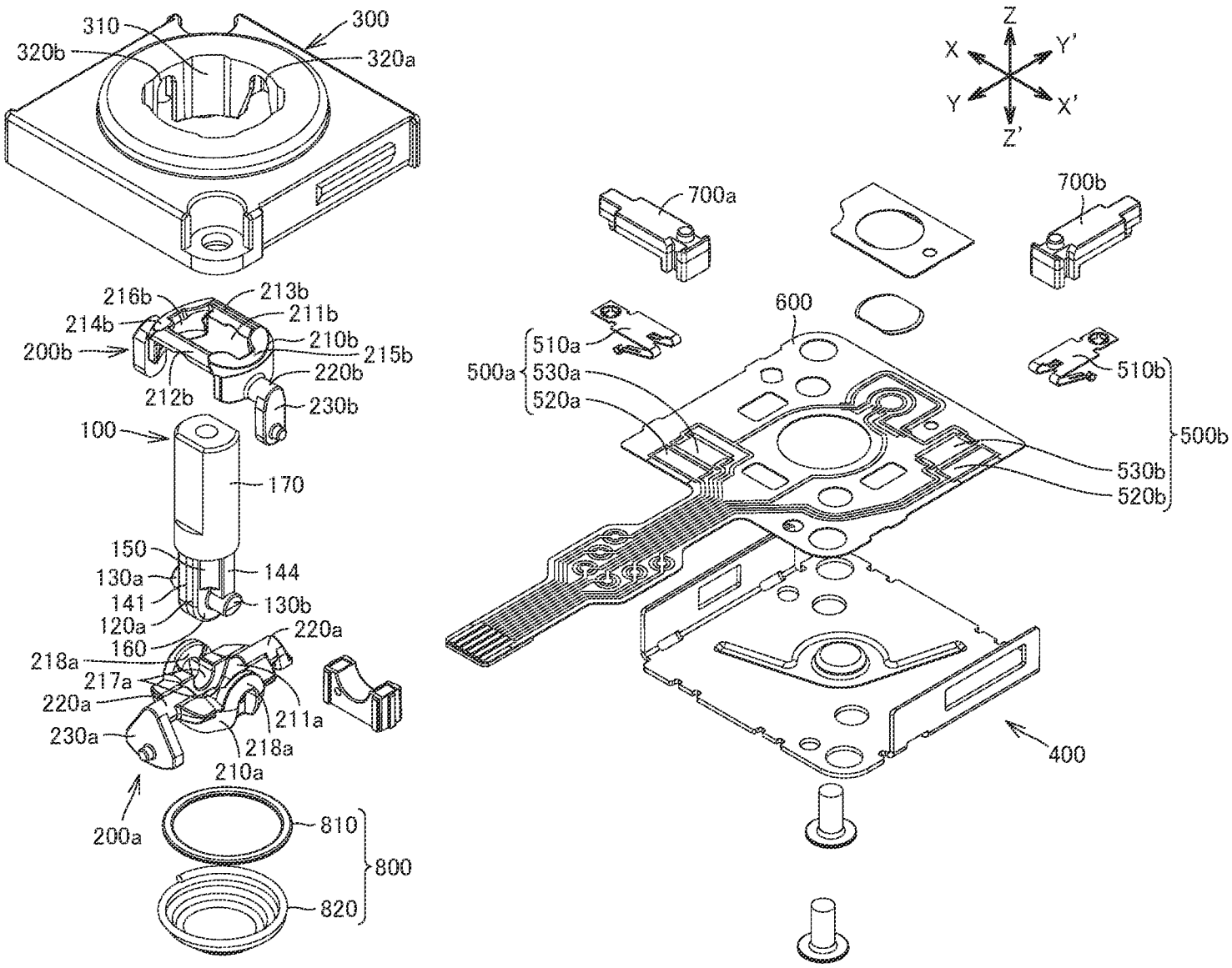
FIG. 4A is an exploded, front, top, right side perspective view of the input device.
Figure 4B:
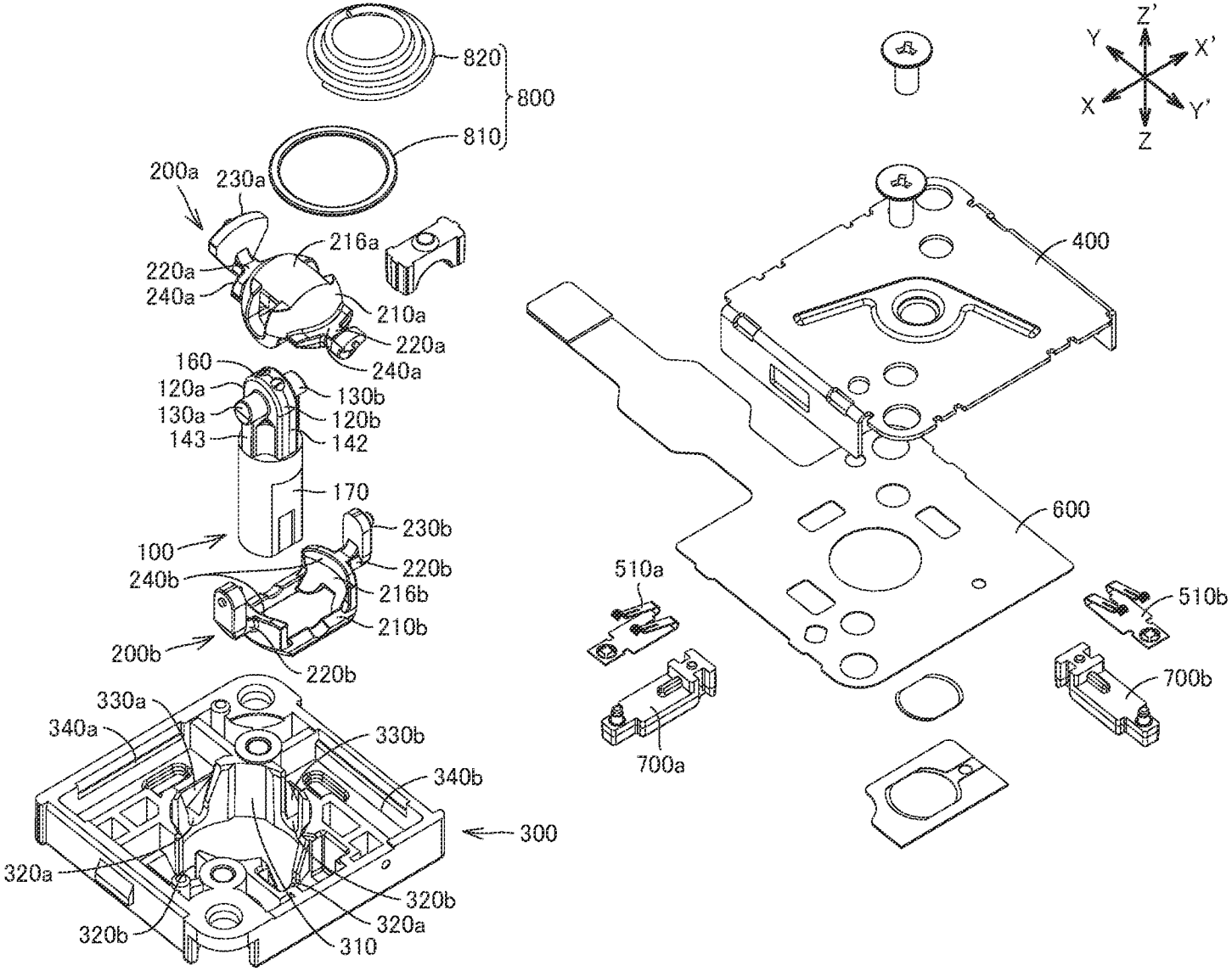
FIG. 4B is an exploded, rear, bottom, left side perspective view of the input device.
Figure 5A:
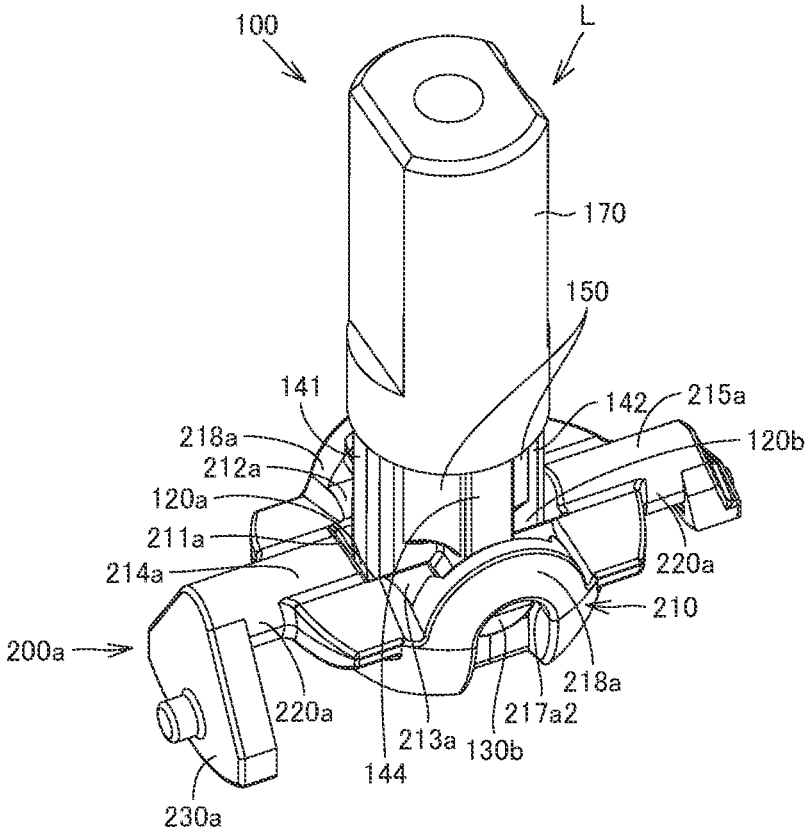
FIG. 5A is a front, top, right side perspective view of an operation lever and a first interlocking member of the input device.
Figure 5B:
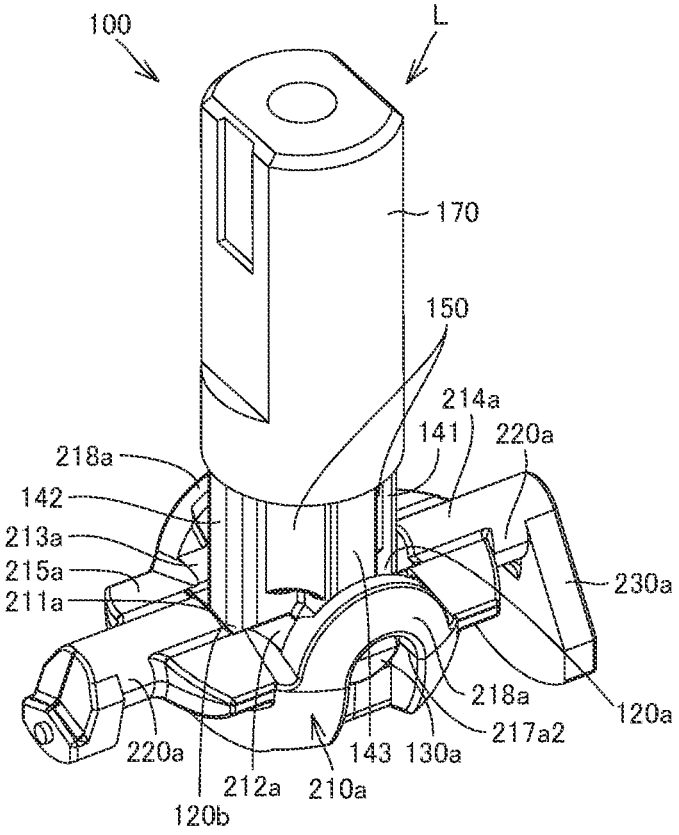
FIG. 5B is a rear, top, left side perspective view of the operation lever and the first interlocking member of the input device with the housing removed.

The first rotation shaft 130*a* may include a first portion 131*a* on the X'-direction side and a second portion 132*a* located on the X-direction side relative to the first portion 131*a*. The first portion 131*a* is contiguous with the base 111. The second portion 132*a* is a part or the entire part of the first rotation shaft 130*a* that is located on the X-direction side relative to the first portion 131*a*. The second rotation shaft 130*b* may include a first portion 131*b* on the X-direction side and a second portion 132*b* located on the X'-direction side relative to the first portion 131*b*. The first portion 131*b* is contiguous with the base 111. The second portion 132*b* is a part or the entire part of the second rotation shaft 130*b* that is located on the X'-direction side relative to the first portion 131*b*.

Where the X-X' direction is substantially orthogonal to the Y-Y' direction, the base 111, the first jut 120*a*, the second jut 120*b*, the first rotation shaft 130*a*, and the second rotation shaft 130*b* of the operation lever 100 in any of the above aspects, collectively, generally form a cross shape in the cross section defined by the Y-Y' and X-X' directions (see FIG. 3C). The base 111, the first jut 120*a*, the second jut 120*b*, the first rotation shaft 130*a*, and the second rotation shaft 130*b* generally of such cross-shaped cross section may be collectively referred to as a cross-shaped portion of the operation lever 100. Where the X-X' direction crosses the Y-Y' direction at an angle other than a right angle, the base 111, the first jut 120*a*, the second jut 120*b*, the first rotation shaft 130*a*, and the second rotation shaft 130*b* of the operation lever 100 in any of the above aspects, collectively, generally form an X shape in the above-described cross section (not shown). The base 111, the first jut 120*a*, the second jut 120*b*, the first rotation shaft 130*a*, and the second rotation shaft 130*b* generally of such X-shaped cross section may be collectively referred to as an X-shaped portion of the operation lever 100.

The operation lever 100 may further include a swingable portion 160. The swingable portion 160 may be a projection being provided on and across the base 111, the first jut 120*a*, and the second jut 120*b* and projecting to the one side in the axial direction (see FIGS. 3A and 3B). Alternatively, the swingable portion 160 may be a projection being provided on the base 111 and projecting to the one side in the axial direction (see FIG. 6). In the former case, the swingable portion 160 is contiguous with the base 111, the first jut 120*a*, and the second jut 120*b*. In the latter case, the swingable portion 160 is contiguous with the base 111, but with neither the first jut 120*a* nor the second jut 120*b*.

In either case, the swingable portion 160 is swingable in the Y-Y' direction. More specifically, the swingable portion 160 is configured to swing in the Y' direction in response to the tilt of the operation lever 100 in the Y direction, and swing in the Y direction in response to the tilt of the operation lever 100 in the Y' direction. The swingable portion 160 has a distal face on the one side in the axial direction. This distal face may be, but is not required to be, a convex face of arc shape curving to the Z'-direction side in the cross section defined by the Y-Y' and Z-Z' directions (see FIGS. 3B and 6), faces of a semi-polygonal shape that approximate to the convex face (not shown), or a convex spherical face projecting to the Z'-direction side (not shown). The swingable portion 160 has a width dimension that is substantially the same, or smaller than, the width dimension of each of the first jut 120*a* and the second jut 120*b*. The swingable portion 160 can be omitted.

For convenience of description, the "first end portion" of the operation lever 100 refers to the combination of the cross-shaped portion and the swingable portion 160 of the operation lever 100, the combination the X-shaped portion and the swingable portion 160 of the operation lever 100, the cross-shaped portion of the operation lever 100 without the swingable portion 160, or the X-shaped portion of the operation lever 100 without the swingable portion 160. The "second end portion" of the operation lever 100 refers to the combination of the base 111, the first jut 120*a*, the second jut 120*b*, and the swingable portion 160 of the operation lever 100, or the combination of the base 111, the first jut 120*a*, and the second jut 120*b* of the operation lever 100 without the swingable portion 160. It should be appreciated that the second end portion of the operation lever 100 is a portion of the operation lever 100 that excludes the first rotation shaft 130*a* and the second rotation shaft 130*b* from the first end portion of the operation lever 100.

The operation lever 100 may further include a core 110. The core 110 is generally of a rectangular prism shape extending in the axial direction of the operation lever 100, and includes a portion on the Z'-direction side, which is the base 111.

The operation lever 100 may further include at least one ridge, namely at least one of a first ridge 141, a second ridge 142, a third ridge 143, or a fourth ridge 144 configured as follows. The first ridge 141 extends from the first jut 120*a* to the other side in the axial direction of the operation lever 100, and extends from the core 110 in the Y direction. The first ridge 141 is contiguous with the first jut 120*a* and the core 110. The second ridge 142 extends from the second jut 120*b* to the other side in the axial direction of the operation lever 100, and extends from the core 110 in the Y' direction. The second ridge 142 is contiguous with the second jut 120*b* and the core 110. The third ridge 143 extends from the first portion 131*a* of the first rotation shaft 130*a*, or alternatively from the first portion 131*a* and the second portion 132*a* of the first rotation shaft 130*a*, to the other side in the axial direction of the operation lever 100, and extends from the core 110 in the X direction. The third ridge 143 is contiguous with the first rotation shaft 130*a* and the core 110. The fourth ridge 144 extends from the first portion 131*b* of the second rotation shaft 130*b*, or alternatively from the first portion 131*b* and the second portion 132*b* of the second rotation shaft 130*b*, to the other side in the axial direction of the operation lever 100, and extends from the core 110 in the X' direction. The fourth ridge 144 is contiguous with the second rotation shaft 130*b* and the core 110.

The at least one ridge may include at least one set of two adjacent ridges. The at least one set is at least one of the following sets: a set consisting of the first ridge 141 and the third ridge 143 adjacent to each other, a set consisting of the third ridge 143 and the second ridge 142 adjacent to each other, a set consisting of the second ridge 142 and the fourth ridge 144 adjacent to each other, and a set consisting of the fourth ridge 144 and the first ridge 141 adjacent to each other. There is a gap between the first ridge 141 and the third ridge 143 adjacent to each other. There is a gap between the third ridge 143 and the second ridge 142 adjacent to each other. There is a gap between the second ridge 142 and the fourth ridge 144 adjacent to each other. There is a gap between the fourth ridge 144 and the first ridge 141 adjacent to each other.

The operation lever 100 may further include at least one reinforcing portion 150. The or each reinforcing portion 150 is suspended between the two adjacent ridges of the or a corresponding set, and is located on the other side in the axial direction relative to the interlocking member 200*a* with a clearance therebetween. The or each reinforcing portion 150 may be contiguous with the or a corresponding set of two adjacent ridges. The distance in the axial direction between the at least one reinforcing portion 150 and the interlocking member 200*a* is set such that, when the operation lever 100 tilts in the Y-Y' direction, the at least one reinforcing portion 150 will not abut the interlocking member 200*a* (for example, in the embodiment shown in FIGS. 2A to 5B, the at least one reinforcing portion 150 will not abut a first edge 212*a* on the X-direction side of a first elongated hole 211*a* and a second edge 213*a* on the X'-direction side of the first elongated hole 211*a* of the interlocking member 200*a*). The outer face of the or each reinforcing portion 150 may be a concave or V-shaped face recessed toward the core 110, may be a flat face, or may be a convex face curving away from the core 110.

The operation lever 100 shown in FIGS. 1 to 5B is configured as follows. The operation lever 100 has the first ridge 141, the second ridge 142, the third ridge 143, the fourth ridge 144, and four reinforcing portions 150. The reinforcing portions 150 are respectively provided between the first ridge 141 and the third ridge 143 adjacent to each other, between the third ridge 143 and the second ridge 142 adjacent to each other, between the second ridge 142 and the fourth ridge 144 adjacent to each other, and between the fourth ridge 144 and the first ridge 141 adjacent to each other. The outer face of each reinforcing portion 150 is a concave face curving toward the core 110.

It is possible to omit the at least one ridge and/or the at least one reinforcing portion 150.

The operation lever 100 may further include an extension 170. The extension 170 extends from the core 110 in the Z direction, or extends from the core 110 and the at least one ridge in the Z direction. The end portion on the Z-direction side of the extension 170, or alternatively a key top (not shown) provided in this end portion, may serve as a handling portion to be handled by a user. The extension 170 can be omitted. Where the extension 170 is omitted, the handling portion may be the core 110, the core 110 and the at least one ridge, a key top (not shown) provided at the core 110, or a key top (not shown) provided at the core 110 and the at least one ridge.

The interlocking member 200*a* extends in the Y-Y' direction. The interlocking member 200*a* includes a main body 210*a*.

The main body 210*a* includes the first elongated hole 211*a*, the first edge 212*a* on the X-direction side of the first elongated hole 211*a*, the second edge 213*a* on the X'-direction side of the first elongated hole 211*a*, a third edge 214*a* on the Y-direction side of the first elongated hole 211*a*, a fourth edge 215*a* on the Y'-direction side of the first elongated hole 211*a*, and a bottom 216*a*. The first elongated hole 211*a* is a blind hole extending in the Y-Y' direction and opening in the Z direction. The first edge 212*a* has a first inner face on the X-direction side of the first elongated hole 211*a*, and the second edge 213*a* has a second inner face on the X'-direction side of the first elongated hole 211*a*. The bottom 216*a* of the main body 210*a* closes the first elongated hole 211*a* on the Z'-direction side and is contiguous with the first, second, third, and fourth edges 212*a*, 213*a*, 214*a*, 215*a*. The bottom 216*a* includes a bottom face 216*a*1 of the first elongated hole 211*a*. The bottom face 216*a*1 may be, but is not required to be, a concave face of arc shape curving to the Z'-direction side in the cross section defined by the Y-Y' and Z-Z' directions (see FIG. 3B), or faces of a semi polygonal shape that approximate to the concave face. Where the swingable portion 160 is omitted, the bottom face 216*a*1 may be a flat face extending in the Y-Y' and X-X' directions.

The first elongated hole 211*a* houses the second end portion of the operation lever 100 (i.e., the combination of the base 111, the first jut 120*a*, the second jut 120*b*, and the swingable portion 160 of the operation lever 100, or the combination of the base 111, the first jut 120*a*, and the second jut 120*b* of the operation lever 100 without the swingable portion 160) from the Z-direction side. The first elongated hole 211*a* has a dimension in the Y-Y' direction (lengthwise dimension) that is larger than the distance in the Y-Y' direction from the end in the Y direction of the first jut 120*a* to the end in the Y' direction of the second jut 120*b* of the operation lever 100 (see FIG. 3B), and has a transverse dimension that satisfies the conditions (1) or (2) described below. Where the X-X' direction is substantially orthogonal to the Y-Y' direction, the transverse direction of the first elongated hole 211*a* corresponds to the X-X' direction, but where the X-X' direction crosses the Y-Y' direction at an angle other than a right angle, the short-side direction of the first elongated hole 211*a* does not correspond to the X-X' direction.

(1) The transverse dimension of the first elongated hole 211*a* is slightly larger than the width dimension of each of the first jut 120*a* and the second jut 120*b* of the operation lever 100 (not shown). In other words, the width dimension of each of the first jut 120*a* and the second jut 120*b* of the operation lever 100 is slightly smaller than the transverse dimension of the first elongated hole 211*a*. In this case, the first jut 120*a* and the second jut 120*b* of the operation lever 100 are received in the first elongated hole 211*a*, and the first jut 120*a* and the second jut 120*b* are opposed respectively to the first inner face of the first edge 212*a* and the second inner face of the second edge 213*a* of the first elongated hole 211*a* with a narrow clearance therebetween. The first jut 120*a* and the second jut 120*b* can swing within the first elongated hole 211*a* in response to the tilt of the operation lever 100 in the Y-Y' direction.

(2) The transverse dimension of the first elongated hole 211*a* is substantially the same as the width dimension of each of the first jut 120*a* and the second jut 120*b* of the operation lever 100 (see FIG. 3C). In this case, the first jut 120*a* and the second jut 120*b* are received in the first elongated hole 211*a* and respectively abut the first inner face of the first edge 212*a* and the second inner face of the second edge 213*a* of the first elongated hole 211*a*. In response to the tilt of the operation lever 100 in the Y-Y' direction, the first jut 120*a* and the second jut 120*b* can swing within the first elongated hole 211*a* while respectively sliding on and along the first inner face of the first edge 212*a* and the second inner face of the second edge 213*a* of the first elongated hole 211*a*.

Where the transverse dimension of the first elongated hole 211*a* satisfies either condition (1) or (2), when the operation lever 100 is twisted to one side in the circumferential direction, the first jut 120*a* presses the first edge 212*a* of the first elongated hole 211*a*, while the second jut 120*b* presses the second edge 213*a* of the first elongated hole 211*a*. When the operation lever 100 is twisted to the other side in the circumferential direction, the first jut 120*a* presses the second edge 213*a* of the first elongated hole 211*a*, while the second jut 120*b* presses the first edge 212*a* of the first elongated hole 211*a*.

The transverse dimension of the first elongated hole 211*a* may be slightly larger than the width dimension of the base 111 of the operation lever 100 (not shown), or may be substantially the same as the width dimension of the base 111 of the operation lever 100 (see FIG. 3C). In the former case, the base 111 is received in the first elongated hole 211*a* and faces the first inner face of the first edge 212*a* and the second inner face of the second edge 213*a* of the first elongated hole 211*a* with a narrow clearance therebetween. The base 111 can rotate within the first elongated hole 211*a* in response to the tilt of the operation lever 100 in the Y-Y' direction. In the latter case, the base 111 is received in the first elongated hole 211*a* and abuts the first inner face of the first edge 212*a* and the second inner face of the second edge 213*a* of the first elongated hole 211*a*. In response to the tilt of the operation lever 100 in the Y-Y' direction, the base 111 can rotate within the first elongated hole 211*a* while sliding on and along the first inner face of the first edge 212*a* and the second inner face of the second edge 213*a* of the first elongated hole 211*a*.

Where the operation lever 100 includes the swingable portion 160, the transverse dimension of the first elongated hole 211*a* may be slightly larger than the width dimension of the swingable portion 160 (not shown), or may be substantially the same as the width dimension of the swingable portion 160 (see FIG. 3A). In the former case, the swingable portion 160 is received in the first elongated hole 211*a* and faces the first inner face of the first edge 212*a* and the second inner face of the second edge 213*a* of the first elongated hole 211*a* with a narrow clearance therebetween. The swingable portion 160 can swing within the first elongated hole 211*a* in response to the tilt of the operation lever 100 in the Y-Y' direction. In the latter case, the swingable portion 160 is received in the first elongated hole 211*a* and abuts the first inner face of the first edge 212*a* and the second inner face of the second edge 213*a* of the first elongated hole 211*a*. In response to the tilt of the operation lever 100 in the Y-Y' direction, the swingable portion 160 can swing within the first elongated hole 211*a* while sliding on and along the first inner face of the first edge 212*a* and the second inner face of the second edge 213*a* of the first elongated hole 211*a*. In either case, the swingable portion 160 is slidable on and along the bottom face 216*a*1 of the first elongated hole 211*a*. In other words, when swinging, the swingable portion 160 slides on and along the bottom face 216*a*1 of the first elongated hole 211*a* in the Y-Y' direction.

The main body 210*a* further has a first shaft hole 217*a* and a second shaft hole 217*a*. The first shaft hole 217*a* is provided in the first edge 212*a*, extends from the first elongated hole 211*a* in the X direction, and communicates with the first elongated hole 211*a*. The second shaft hole 217*a* is provided in the second edge 213*a*, extends from the first elongated hole 211*a* in the X' direction, and communicates with the first elongated hole 211*a*. The first rotation shaft 130*a* of the operation lever 100 is rotatably supported in the first shaft hole 217*a*, and the second rotation shaft 130*b* of the operation lever 100 is rotatably supported in the second shaft hole 217*a*. The first shaft hole 217*a*, the second shaft hole 217*a*, the first rotation shaft 130*a*, and the second rotation shaft 130*b* may, but are not required to, further have one of the following configurations (3), (4), or (5).

(3) The first shaft hole 217*a* has a first recess 217*a*1 and the second shaft hole 217*a* has a second recess 217*a*1. The first recess 217*a*1 is provided in the first edge 212*a*, extends from the first elongated hole 211*a* in the X direction, communicates with the first elongated hole 211*a*, and opens in the Z direction. The second recess 217*a*1 is provided in the second edge 213*a*, extends from the first elongated hole 211*a* in the X' direction, communicates with the first elongated hole 211*a*, and opens in the Z direction. The bottom face of each of the first recess 217*a*1 and the second recess 217*a*1 may be a concave face of arc shape curving to the Z'-direction side, or a face of a semi polygonal shape that approximates to the concave face, in the cross section defined by the Z-Z' direction and the transverse direction of the first recess 217*a*1 and the second recess 217*a*1 (see FIG. 2B). The transverse dimension of the first recess 217*a*1 may be substantially the same as, or smaller than, the diameter of the first portion 131*a* of the first rotation shaft 130*a*, or each of the diameters of the first portion 131*a* and the second portion 132*a* of the first rotation shaft 130*a*. The transverse the dimension of the second recess 217*a*1 may be substantially the same as, or smaller than, the diameter of the first portion 131*b* of the second rotation shaft 130*b*, or each of the diameters of the first portion 131*b* and the second portion 132*b* of the second rotation shaft 130*b*. The first portion 131*a*, or the first portion 131*a* and the second portion 132*a*, of the first rotation shaft 130*a* may be rotatably supported in the first recess 217*a*1. The first portion 131*b*, or the first portion 131*b* and the second portion 132*b*, of the second rotation shaft 130*b* may be rotatably supported in the second recess 217*a*1.

(4) The first shaft hole 217*a* includes the first recess 217*a*1 and a first lateral hole 217*a*2, and the second shaft hole 217*a* includes the second recess 217*a*1 and a second lateral hole 217*a*2. The first lateral hole 217*a*2 extends from the first recess 217*a*1 in the X direction and communicates with the first recess 217*a*1. The second lateral hole 217*a*2 extends from the second recess 217*a*1 in the X' direction and communicates with the second recess 217*a*1. In the side view from the X-direction side, the first lateral hole 217*a*2 may have a generally circular shape, a generally circular shape with a missing part, or a polygonal shape that approximates to the generally circular shape or the generally circular shape with a missing part. In the side view from the X'-direction side, the second lateral hole 217*a*2 may have a generally circular shape, a generally circular shape with a missing part, or a polygonal shape that approximates to the generally circular shape or the generally circular shape with a missing part. The diameter of the first lateral hole 217*a*2 is substantially the same as, or slightly larger than, the outer diameter of the second portion 132*a* of the first rotation shaft 130*a*. The diameter of the second lateral hole 217*a*2 is substantially the same as, or slightly larger than, the outer diameter of the second portion 132*b* of the second rotation shaft 130*b*. The first portion 131*a* of the first rotation shaft 130*a* may be rotatably supported in the first recess 217*a*1, and the second portion 132*a* of the first rotation shaft 130*a* may be rotatably supported in the first lateral hole 217*a*2. The first portion 131*b* of the second rotation shaft 130*b* may be rotatably supported in the second recess 217*a*1, and the second portion 132*b* of the second rotation shaft 130*b* may be rotatably supported in the second lateral hole 217*a*2.

Where the first shaft hole 217*a* has the first lateral hole 217*a*2 and the second shaft hole 217*a* has the second lateral hole 217*a*2, the main body 210*a* further includes a first shaft supporting arm 218*a* and a second shaft supporting arm 218*a*. The first shaft supporting arm 218*a* is an edge portion on the Z-direction side of the first lateral hole 217*a*2, and abuts the second portion 132*a* of the first rotation shaft 130*a* from the Z-direction side. The second shaft supporting arm 218*a* is an edge portion on the Z-direction side of the second lateral hole 217*a*2, and abuts the second portion 132*b* of the second rotation shaft 130*b* from the Z-direction side. In other words, the second portion 132*a* of the first rotation shaft 130*a* rotatably abuts the first shaft supporting arm 218*a* from the Z'-direction side. The second portion 132*b* of the second rotation shaft 130*b* rotatably abuts the second shaft supporting arm 218*a* from the Z'-direction side.

(5) Where the third ridge 143 and the fourth ridge 144 are omitted, the first shaft hole 217*a* may have a first lateral hole 217*a*2, and the second shaft hole 217*a* may have a second lateral hole 217*a*2. In this case, the first recess 217*a*1 and the second recess 217*a*1 are omitted. The first lateral hole 217*a*2 of the first shaft hole 217*a* of this aspect is configured as described above, except that first lateral hole 217*a*2 of the first shaft hole 217*a* is provided in the first edge 212*a*, extends from the first elongated hole 211*a* in the X direction, and communicates with the first elongated hole 211*a*. The second lateral hole 217*a*2 of the second shaft hole 217*a* is configured as described above, except that the second lateral hole 217*a*2 of the second shaft hole 217*a* of this aspect is provided in the second edge 213*a*, extends from the first elongated hole 211*a* in the X' direction, and communicates with the first elongated hole 211*a*. Rotatably supported in the first lateral hole 217*a*2 is the first portion 131*a* of the first rotation shaft 130*a*, or alternatively the first portion 131*a* and the second portion 132*a* of the first rotation shaft 130*a*. Rotatably supported in the second lateral hole 217*a*2 is the first portion 131*b* of the second rotation shaft 130*b*, or alternatively the first portion 131*b* and the second portion 132*b* of the second rotation shaft 130*b*. The first portion 131*a* of the first rotation shaft 130*a*, or alternatively the first portion 131*a* and the second portion 132*a* of the first rotation shaft 130*a*, rotatably abut the first shaft supporting arm 218*a* from the Z'-direction side. The first portion 131*b* of the second rotation shaft 130*b*, or alternatively the first portion 131*b* and the second portion 132*b* of the second rotation shaft 130*b*, rotatably abut the second shaft supporting arm 218*a* from the Z'-direction side.

Where the first recess 217*a*1 and the second recess 217*a*1 are omitted, the first ridge 141 and/or the second ridge 142 can also be omitted.

The first shaft supporting arm 218*a* may be elastically deformable in the X direction until the first shaft supporting arm 218*a* is released from the abutment against the first rotation shaft 130*a*, and the second shaft supporting arm 218*a* may be elastically deformable in the X' direction until the second shaft supporting arm 218*a* is released from the abutment against the second rotation shaft 130*b* is released. In this case, when assembling the operation lever 100 to the first interlocking member 200*a*, the first rotation shaft 130*a* and the second rotation shaft 130*b* of the operation lever 100 may be rotatably supported respectively by the first shaft hole 217*a* and the second shaft hole 217*a* having the configuration (4) or (5) and may rotatably abut the first shaft supporting arm 218*a* and the second shaft supporting arm 218*a*, respectively, in the following manner. The second end portion of the operation lever 100 is inserted into the first elongated hole 211*a* from the Z-direction side, and the first rotation shaft 130*a* and the second rotation shaft 130*b* of the operation lever 100 are inserted from the Z-direction side between the first shaft supporting arm 218*a* and the second shaft supporting arm 218*a*. In this process, the first rotation shaft 130*a* and the second rotation shaft 130*b* of the operation lever 100 move in the Z' direction while respectively pressing the first shaft supporting arm 218*a* and the second shaft supporting arm 218*a*, and the first shaft supporting arm 218*a* and the second shaft supporting arm 218*a* elastically deform respectively in the X and X' directions. When the first rotation shaft 130*a* and the second rotation shaft 130*b* respectively climb over the first shaft supporting arm 218*a* and the second shaft supporting arm 218*a*, the first shaft supporting arm 218*a* and the second shaft supporting arm

218*a* restore themselves to respectively abut the first rotation shaft 130*a* and the second rotation shaft 130*b* from the Z-direction side, so that the first rotation shaft 130*a* and the second rotation shaft 130*b* are inserted into the first shaft hole 217*a* and the second shaft hole 217*a*, and the second end portion of the operation lever 100 is inserted, or fitted, into the first elongated hole 211*a* of the interlocking member 200*a* from the Z-direction side.

Alternatively, the first shaft supporting arm 218*a* and the second shaft supporting arm 218*a* may not be configured to elastically deform as described above. In this case, it is possible to provide a shaft including the first rotation shaft 130*a* and the second rotation shaft 130*b* separately from the operation lever 100, and to provide the base 111 of the second end portion of the operation lever 100 with a fixing hole extending through the base 111 in the X-X' direction. When assembling the operation lever 100 to the first interlocking member 200*a*, after the second end portion of the operation lever 100 is inserted, or fitted, into the first elongated hole 211*a*, the shaft may be inserted into the first shaft hole 217*a*, the fixing hole, and the second shaft hole 217*a* and held by the base 111.

Where the X-X' direction is substantially orthogonal to the Y-Y' direction, the first elongated hole 211*a*, the first shaft hole 217*a*, and the second shaft hole 217*a* in any of the above aspects, collectively, form a recess generally of a cross shape in the cross section defined by the Y-Y' and X-X' directions (see FIG. 3C). The first elongated hole 211*a*, the first shaft hole 217*a*, and the second shaft hole 217*a* generally of such cross-shaped cross section may be collectively referred to as a cross-shaped recess of the interlocking member 200*a*. As described above, received or fitted in the cross-shaped recess of the interlocking member 200*a* is the cross-shaped portion of the operation lever 100 without the swingable portion 160, or alternatively the cross-shaped portion and the swingable portion 160 of the operation lever 100. Where the X-X' direction crosses the Y-Y' direction at an angle other than a right angle, the first elongated hole 211*a*, the first shaft hole 217*a*, and the second shaft hole 217*a* in any of the above aspects, collectively, form a recess generally of an X shape in the cross section defined by the Y-Y' and X-X' directions (not shown). The first elongated hole 211*a*, the first shaft hole 217*a*, and the second shaft hole 217*a* generally of such X-shaped cross section may be collectively referred to as an X-shaped recess of the interlocking member 200*a*. As described above, received or fitted in the X-shaped recess of the interlocking member 200*a* is the X-shaped portion of the operation lever 100 without the swingable portion 160, or alternatively the X-shaped portion and the swingable portion 160 of the operation lever 100.

The interlocking member 200*a* may further includes a pair of pivot shafts 220*a* extending from the main body 210*a* in the Y and Y' directions, respectively. Each pivot shaft 220*a* is a cylinder, or alternatively a polygonal prism that approximates to a cylinder. In other words, one of the pivot shafts 220*a* is a cylinder, or alternatively a polygonal prism that approximates to a cylinder, that extends from the main body 210*a* in the Y direction, and the other pivot shaft 220*a* is a cylinder, or alternatively a polygonal prism that approximates to a cylinder, that extends from the main body 210*a* in the Y' direction. The main body 210*a* of the interlocking member 200*a* is pivotable in the X-X' direction from its initial position, with the pair of pivot shafts 220*a* serving as the pivot. As described above, the first end portion of the operation lever 100 is received or fitted in the cross-shaped or X-shaped recess of the main body 210*a*. As such, when the main body 210*a* pivots from the initial position in the X direction with the pivot shafts 220*a* serving as the pivot, this causes the operation lever 100 to tilt from the neutral position in the X direction. When the main body 210*a* pivots from the initial position in the X' direction with the pivot shafts 220*a* serving as the pivot, this causes the operation lever 100 to tilt from the neutral position in the X' direction. In other words, the operation lever 100 is configured to tilt in the X and X' directions with the pivot shafts 220*a* serving as the pivot, and the interlocking member 200*a* is configured to accordingly pivot in the X or X' direction with the pivot shafts 220*a* serving as the pivot. The initial position of the main body 210*a* may be the position at which the main body 210*a* is located with the operation lever 100 located at the neutral position.

The operation lever 100 may be configured to be tiltable from the neutral position in a first oblique direction, a second oblique direction, a third oblique direction, and/or a fourth oblique direction. The first oblique direction is a direction including components of the Y and X directions. The second oblique direction is a direction including components of the Y and X' directions. The third oblique direction is a direction including components of the Y' and X directions. The fourth direction is a direction including components of the Y' and X' directions.

When the operation lever 100 tilts from the neutral position in the first oblique direction, the operation lever 100 tilts in the Y direction with the first rotation shaft 130*a* and the second rotation shaft 130*b* serving as the pivot, and tilts in the X direction with the pivot shafts 220*a* of the interlocking member 200*a* serving as the pivot, and the main body 210*a* of the interlocking member 200*a* pivots from the initial position in the X direction. When the operation lever 100 tilts from the neutral position in the second oblique direction, the operation lever 100 tilts in the Y direction with the first rotation shaft 130*a* and the second rotation shaft 130*b* serving as the pivot, and tilts in the X' direction with the pivot shafts 220*a* of the interlocking member 200*a* serving as the pivot, and the main body 210*a* of the interlocking member 200*a* pivots from the initial position in the X' direction. When the operation lever 100 tilts from the neutral position in the third oblique direction, the operation lever 100 tilts in the Y' direction with the first rotation shaft 130*a* and the second rotation shaft 130*b* serving as the pivot, and tilts in the X direction with the pivot shafts 220*a* of the interlocking member 200*a* serving as the pivot, and the main body 210*a* of the interlocking member 200*a* pivots from the initial position in the X direction. When the operation lever 100 tilts from the neutral position in the fourth oblique direction, the operation lever 100 tilts in the Y' direction with the first rotation shaft 130*a* and the second rotation shaft 130*b* serving as the pivot, and tilts in the X' direction with the pivot shafts 220*a* of the interlocking member 200*a* serving as the pivot, and the main body 210*a* of the interlocking member 200*a* pivots from the initial position in the X' direction.

Hereinafter, the Y direction, the first oblique direction, or the second oblique direction may be referred to as a direction including a component of the Y direction; the Y' direction, the third oblique direction, or the fourth oblique direction may be referred to as a direction including a component of the Y' direction; the X direction, the first oblique direction, or the third oblique direction may be referred to as a direction including a component of the X direction; and the X' direction, the second oblique direction, or the fourth oblique direction may be referred to as a direction including a component of the X' direction.

The linking structure L of any of the above aspects may further include a second interlocking member 200*b* (which may be hereinafter referred to simply as an interlocking member 200*b*). The interlocking member 200*b* extends in the X-X' direction. The interlocking member 200*b* intersects the first interlocking member on the Z-direction side relative to the first interlocking member 200*a*. The interlocking member 200*b* includes a main body 210*b*.

The main body 210*b* includes a second elongated hole 211*b*, a first edge 212*b* on the Y-direction side of the second elongated hole 211*b*, a second edge 213*b* on the Y'-direction side of the second elongated hole 211*b*, a third edge 214*b* on the X-direction side of the second elongated hole 211*b*, and a fourth edge 215*b* on the X'-direction side of the second elongated hole 211*b*. The second elongated hole 211*b* is a through hole formed through the main body 210*b* in the Z-Z' direction and extends in the X-X' direction.

The operation lever 100 of any of the above aspects passes through the second elongated hole 211*b* such as to be tiltable in the X-X' direction inside the second elongated hole 211*b*. The operation lever 100 may slidably abut the first edge 212*b* of the second elongated hole 211*b* and the second edge 213*b* of the second elongated hole 211*b*. Alternatively the operation lever 100 may be opposed with a narrow interstice to, and abuttable against, the first edge 212*b* of the second elongated hole 211*b* and the second edge 213*b* of the second elongated hole 211*b*. For example, where the operation lever 100 includes the first ridge 141 and the second ridge 142, the first ridge 141 and the second ridge 142 of the operation lever 100 may slidably abut the first edge 212*b* and the second edge 213*b*, respectively (see FIGS. 1 to 6), or may be opposed with a narrow interstice to, and abuttable against, the first edge 212*b* and the second edge 213*b*. Where the operation lever 100 is provided without the first ridge 141, the core 110 of the operation lever 100 may slidably abut the first edge 212*b*, or may be opposed with a narrow interstice to, and abuttable against, the first edge 212*b*. When the operation lever 100 is provided without the second ridge 142, the core 110 of the operation lever 100 may slidably abut the second edge 213*b*, or may be opposed with a narrow interstice to, and abuttable against, the second edge 213*b*.

Where the first shaft supporting arm 218*a* and the second shaft supporting arm 218*a* are provided, the main body 210*b* may further include a first guide 216*b* and a second guide 216*b*.

The first guide 216*b* is provided on the third edge 214*b* of the second elongated hole 211*b*, and is located on a first oblique-direction side, or on the X-direction side, relative to the first shaft supporting arm 218*a*. The first oblique direction includes components of the X and Z directions. For example, where the first shaft supporting arm 218*a* is generally of arc-shape extending in the Y-Y' direction and projecting in the Z direction, the first guide 216*b* is a wall of the third edge 214*b* and covers the first shaft supporting arm 218*a* from the oblique-direction side or the X-direction side. The face on the X'-direction side of the first guide 216*b* is provided with a recess generally of arc shape extending in the Y-Y' direction and being recessed in the Z direction (see FIGS. 3A and 4B), or alternatively a ridge generally of arc shape extending in the Y-Y' direction and projecting in the Z direction. The recess or the ridge serves to guide the first shaft supporting arm 218*a* such as to be swingable in the Y-Y' direction. Where the first shaft supporting arm 218*a* is elastically deformable in the X direction, the first guide 216*b* guides the first shaft supporting arm 218*a* from the oblique-direction side or the X-direction side so as to suppress elastic deformation of the first shaft supporting arm 218*a* in the X direction.

The second guide 216*b* is provided on the fourth edge 215*b* of the second elongated hole 211*b*, and is located on a second oblique-direction side, or alternatively on the X'-direction side, relative to the second shaft supporting arm 218*a*. The second oblique direction includes components of the X' and Z directions. For example, where the second shaft supporting arm 218*a* is generally of arc-shape extending in the Y-Y' direction and projecting in the Z direction, the second guide 216*b* is a wall of the fourth edge 215*b* and covers the second shaft supporting arm 218*a* from the oblique-direction side or the X'-direction side. The face on the X-direction side of the second guide 216*b* is provided with a recess generally of arc shape extending in the Y-Y' direction and being recessed in the Z direction (see FIGS. 3A and 4B), or alternatively a ridge generally of arc shape extending in the Y-Y' direction and projecting in the Z direction. The recess or the ridge serves to guide the second shaft supporting arm 218*a* such as to be swingable in the Y-Y' direction. Where the second shaft supporting arm 218*a* is elastically deformable in the X' direction, the second guide 216*b* guides the second shaft supporting arm 218*a* from the oblique-direction side or the X'-direction side so as to suppress elastic deformation of the second shaft supporting arm 218*a* in the X' direction. The first guide 216*b* and the second guide 216*b* can be omitted.

Where the first shaft supporting arm 218*a* and the second shaft supporting arm 218*a* are not provided, the main body 210*b* may include a first retaining portion and a second retaining portion (not shown). The first retaining portion is provided on the third edge 214*b*, abuts the first rotation shaft 130*a* from the Z-direction side, and supports the first rotation shaft 130*a* in a rotatable manner. The second retaining portion is provided on the fourth edge 215*b*, abuts the second rotation shaft 130*b* from the Z-direction side, and supports the second rotation shaft 130*b* in a rotatable manner. The first retaining portion and the second retaining portion can be omitted.

Where the first ridge 141, the second ridge 142, the third ridge 143, and the fourth ridge 144 are provided, the third edge 214*b* of the second elongated hole 211*b* may include a first protrusion 217*b* protruding toward the gap between the first ridge 141 and the third ridge 143, and a second protrusion 217*b* protruding toward the gap between the third ridge 143 and the second ridge 142; and the fourth edge 215*b* of the second elongated hole 211*b* may include a third protrusion 217*b* protruding toward the gap between the second ridge 142 and the fourth ridge 144, and a fourth protrusion 217*b* protruding toward the gap between the fourth ridge 144 and the first ridge 141.

The amount of protrusion of the first protrusion 217*b* may be set such that the operation lever 100 will abut neither the first ridge 141 nor the third ridge 143 when the operation lever 100 tilts in a direction including the component of the Y direction and/or the component of the X direction. Alternatively, where the reinforcing portion 150 is provided between the first ridge 141 and the third ridge 143, the amount of protrusion of the first protrusion 217*b* may be set such that the operation lever 100 will not abut the reinforcing portion 150 when the operation lever 100 tilts in a direction including the component of the Y direction and/or the component of the X direction. The amount of protrusion of the second protrusion 217*b* may be set such that the operation lever 100 will abut neither the third ridge 143 nor the second ridge 142 when the operation lever 100 tilts in a direction including the component of the Y' direction and/or the component of the X direction. Alternatively, where the reinforcing portion 150 is provided between the third ridge 143 and the second ridge 142, the amount of protrusion of the second protrusion 217*b* may be set such that the operation lever 100 will not abut the reinforcing portion 150 when the operation lever 100 tilts in a direction including the component of the Y' direction and/or the component of the X direction. The amount of protrusion of the third protrusion 217*b* may be set such that the operation lever 100 will abut neither the second ridge 142 nor the fourth ridge 144 when the operation lever 100 tilts in a direction including the component of the Y' direction and/or the component of the X' direction. Alternatively, where the reinforcing portion 150 is provided between the second ridge 142 and the fourth ridge 144, the amount of protrusion of the third protrusion 217*b* may be set such that the operation lever 100 will not abut the reinforcing portion 150 when the operation lever 100 tilts in a direction including the component of the Y' direction and/or the component of the X' direction. The amount of protrusion of the fourth protrusion 217*b* may be set such that the operation lever 100 will abut neither the fourth ridge 144 nor the first ridge 141 when the operation lever 100 tilts in a direction including the component of the Y direction and/or the component of the X' direction. Alternatively, where the reinforcing portion 150 is provided between the fourth ridge 144 and the first ridge 141, the amount of protrusion of the fourth protrusion 217*b* may be set such that the operation lever 100 will not abut the reinforcing portion 150 when the operation lever 100 tilts in a direction including the component of the Y direction and/or the component of the X' direction. The provision of the first to fourth protrusions 217*b* improves the strength of the main body 210*b* of the interlocking member 200*b*. Any of the first to fourth protrusions 217*b* can be omitted.

The interlocking member 200*b* further includes a pair of pivot shafts 220*b* extending from the main body 210*b* in the X and X' direction, respectively. Each pivot shaft 220*b* is a cylinder, or alternatively a polygonal prism that approximates to a cylinder. In other words, one of the pivot shafts 220*b* is a cylinder, or alternatively a polygonal prism that approximates to a cylinder, that extends from the main body 210*b* in the X direction, and the other pivot shaft 220*b* is a cylinder, or alternatively a polygonal prism that approximates to a cylinder, that extends from the main body 210*b* in the X' direction. The interlocking member 200*b* is pivotable in the Y-Y' direction with the pivot shafts 220*b* serving as the pivot.

When the operation lever 100 tilts from the neutral position in a direction including the component of the Y direction with the first rotation shaft 130*a* and the second rotation shaft 130*b* serving as the pivot, the operation lever 100 presses the first edge 212*b* of the main body 210*b* of the interlocking member 200*b* in the Y direction, so that the main body 210*b* pivots from the initial position in the Y direction. When the operation lever 100 tilts from the neutral position in a direction including the component of the Y' direction with the first rotation shaft 130*a* and the second rotation shaft 130*b* serving as the pivot, the operation lever 100 presses the second edge 213*b* of the main body 210*b* of the interlocking member 200*b* in the Y' direction, so that the main body 210*b* pivots from the initial position in the Y' direction. The initial position of the main body 210*b* may be the position at which the main body 210*b* is located with the operation lever 100 located at the neutral position.

The input device D may further include a housing 300. The housing 300 may have either of the following configurations (a) or (b).

(a) The housing 300 includes an accommodating portion 310, a pair of first supports 320*a*, and a pair of second supports 320*b*. The accommodating portion 310 is an accommodating space provided in the housing 300 with an opening on the Z-direction side and an opening on the Z'-direction side. The accommodating portion 310 accommodates, from the Z'-direction side, the first end portion of the operation lever 100, the main body 210*a* of the interlocking member 200*a*, and the main body 210*b* of the interlocking member 200*b*. Protruded from the accommodating portion 310 to the other side in the axial direction is a portion of the operation lever 100 that is located on the other side in the axial direction relative to the first end portion of the operation lever 100. The main body 210*b* of the interlocking member 200*b* may partly protrude from the accommodating portion 310 to the Z-direction side, or may be entirely accommodated in the accommodating portion 310. The first supports 320*a* have respective recesses extending from the accommodating portion 310 in the Y and Y' directions, respectively. The recesses of the first supports 320*a* communicate with the accommodating portion 310 and open in the Z' direction. The recesses of the first supports 320*a* accommodate the pair of pivot shafts 220*a* of the interlocking member 200*a* from the Z'-direction side, and the edges on the X- and X'-direction sides of the recesses of the first supports 320*a* support the pivot shafts 220*a* such as to be rotatable in the X-X' direction. The second supports 320*b* have recesses extending from the accommodating portion 310 in the X and X' directions, respectively. The recesses communicate with the accommodating portion 310 and open in the Z' direction. The recesses of the second supports 320*b* accommodate the pair of pivot shafts 220*b* of the interlocking member 200*b* from the Z'-direction side, the edges on the Y- and Y'-direction sides of the recesses support the pivot shafts 220*b* such as to be rotatable in the Y-Y' direction. The first supports 320*a* may further include respective support bases to rotatably support the pivot shafts 220*a* from the Z'-direction side. The second supports 320*b* may further include respective support bases to rotatably support the pivot shafts 220*b* from the Z'-direction side.

(b) Configuration of (a) above may be modified such that the first supports 320*a* and the second supports 320*b* are replaced with a pair of first supports and a pair of second supports (not shown) provided separately from the housing 300. In this case, the accommodating portion 310 accommodates, from the Z'-direction side, the first end portion of the operation lever 100, the main body 210*a* of the interlocking member 200*a*, the pair of pivot shafts 220*a* of the interlocking member 200*a*, the main body 210*b* of the interlocking member 200*b*, and the pair of pivot shafts 220*b* of the interlocking member 200*b*. The first supports are support bases accommodated in the accommodating portion 310 and have respective pivot holes extending in the Y-Y' direction. The pivot shafts 220*a* are supported in the pivot holes of the first supports such as to be pivotable in the X-X' direction. The second supports are support bases accommodated in the accommodating portion 310 and have respective pivot holes extending in the X-X' direction. The pivot shafts 220*b* of the interlocking member 200*b* are supported in the pivot holes of the second supports such as to be pivotable in the Y-Y' direction.

The interlocking member 200*a* may further include at least one pivotable portion 230*a* extending in the Z' direction from at least one of the pivot shafts 220*a*. The at least one pivotable portion 230*a* is configured to pivot from its initial position in the X' direction in accordance with the tilt of the operation lever 100 in a direction including the component of the X direction and the rotation of the pivot shafts 220*a* in the X direction. The at least one pivotable portion 230*a* is also configured to pivot from its initial position in the X direction in accordance with the tilt of the operation lever 100 in a direction including the component of the X' direction and the rotation of the pivot shafts 220*a* in the X' direction. The initial position of the pivotable portion 230*a* may be the position at which the pivotable portion 230*a* is located with the operation lever 100 located at the neutral position.

The interlocking member 200*b* may further include at least one pivotable portion 230*b* extending in the Z' direction from at least one of the pivot shafts 220*b*. The at least one pivotable portion 230*b* is configured to pivot from its initial position in the Y' direction in accordance with the tilt of the operation lever 100 in a direction including the component of the Y direction and the rotation of the pivot shafts 220*b* in the Y direction. The at least one pivotable portion 230*b* is also configured to pivot from its initial position in the Y direction in accordance with the tilt of the operation lever 100 in a direction including the component of the Y' direction and the rotation of the pivot shafts 220*b* in the Y' direction. The initial position of the pivotable portion 230*b* may be the position at which the pivotable portion 230*b* is located with the operation lever 100 located at the neutral position.

Where the housing 300 has configuration (a) above, the housing 300 may further have at least one accommodating hole 330*a* and at least one accommodating hole 330*b*. The at least one accommodating hole 330*a* is provided on an outer side (on the Y-direction side in FIGS. 3B and 4B) relative to at least one of the first supports 320*a*, and accommodates the at least one pivotable portion 230*a*. The at least one accommodating hole 330*b* is provided on an outer side (on the X'-direction side in FIGS. 3A and 4B) relative to at least one of the second supports 320*b*, and accommodates the at least one pivotable portion 230*b*.

Where the housing 300 has configuration (b) above, the at least one pivotable portion 230*a* and the at least one pivotable portion 230*b* may be accommodated in the accommodating portion 310 of the housing 300 from the Z'-direction side.

The input device D may further include a frame 400, a circuit board 600, a slider 700*a*, and a slider 700*b*. The circuit board 600 is arranged on the Z'-direction side relative to the housing 300. The frame 400 is attached to the housing 300 from the Z'-direction side. The circuit board 600 is held between the housing 300 and the frame 400. Where the circuit board 600 is fixed to the housing 300, the frame 400 can be omitted.

The slider 700*a* is engaged with the at least one pivotable portion 230*a* of the interlocking member 200*a*. For example, one of the slider 700*a* or the at least one pivotable portion 230*a* is provided with an engaging protrusion, and the other is provided with an engaging recess to receive the engaging protrusion. When the at least one pivotable portion 230*a* pivots in the X' or X direction to press the slider 700*a* in the X' or X direction, this causes the slider 700*a* to slide from its initial position in the same direction on and along the circuit board 600. The initial position of the slider 700*a* may be the position at which the slider 700*a* is located with the pivotable portion 230*a* located at its initial position.

Similarly to the slider 700*a*, the slider 700*b* is engaged with the at least one pivotable portion 230*b* of the interlocking member 200*b*. When the at least one pivotable portion 230*b* pivots in the Y' or Y direction to press the slider 700*b* in the Y' or Y direction, this causes the slider 700*b* to slide from its initial position in the same direction on and along the circuit board 600. The initial position of the slider 700*b* may be the position at which the slider 700*b* is located with the pivotable portion 230*b* located at its initial position.

The housing 300 may further includes a movement channel 340*a* and a movement channel 340*b*. The movement channel 340*a* accommodates the slider 700*a* such as to be movable in the X-X' direction. The movement channel 340*b* accommodates the slider 700*b* such as to be movable in the Y-Y' direction.

The input device D may further include a detector 500*a* (second detector) and a detector 500*b* (first detector). The detector 500*a* is configured to detect the tilt of the operation lever 100 in a direction including the component of the X direction and the tilt of the operation lever 100 in a direction including the component of the X' direction, and to change a signal from the detector 500*a* in response to the amount of the tilt or output a signal from the detector 500*a* based on the tilt. The detector 500*b* is configured to detect the tilt of the operation lever 100 in a direction including the component of the Y direction and the tilt of the operation lever 100 in a direction including the component of the Y' direction, and to change a signal from the detector 500*b* in response to the amount of the tilt or output a signal from the detector 500*b* based on the tilt.

For example, the detectors 500*a* and 500*b* may be variable resistors. In this case, the detector 500*a* includes a wiper 510*a* which is electrically conductive, a resistor 520*a*, and a conductor 530*a*, while the detector 500*b* includes a wiper 510*b* which is electrically conductive, a resistor 520*b*, and a conductor 530*b*.

The resistor 520*a* and the conductor 530*a* of the detector 500*a* are formed on an end portion on the Y-direction side of the circuit board 600. The wiper 510*a* of the detector 500*a* is accommodated in an accommodation recess of the slider 700*a* and fixed to the ceiling (the face on the Z-direction side) of the accommodation recess. The wiper 510*a* is in contact with the resistor 520*a* and the conductor 530*a* to establish electrical conduction between the resistor 520*a* and the conductor 530*a*. The wiper 510*a* is slidable on and along the resistor 520*a* and the conductor 530*a* in accordance with the movement of the slider 700*a* in the X' or X direction. The sliding of the wiper 510*a* on the resistor 520*a* and the conductor 530*a* changes a resistance value of the detector 500*a* (a signal from the detector 500*a*). This change in resistance value is inputted via the circuit board 600 into a control part of an electronic device that is mounted with the input device D, and the control part detects that the operation lever 100 has tilted in a direction including the component of the X or X' direction and also detects the amount of the tilt.

The resistor 520*b* and the conductor 530*b* of the detector 500*b* are formed on an end portion on the X'-direction side of the circuit board 600. The wiper 510*b* of the detector 500*b* is accommodated in an accommodation recess of the slider 700*b* and fixed to the ceiling (the face on the Z-direction side) of the accommodation recess. The wiper 510*b* is in contact with the resistor 520*b* and the conductor 530*b* to establish electrical conduction between the resistor 520*b* and the conductor 530*b*. The wiper 510*b* is slidable on and along the resistor 520*b* and the conductor 530*b* in accordance with the movement of the slider 700*b* in the Y' or Y direction. The sliding of the wiper 510*b* on the resistor 520*b* and the conductor 530*b* changes a resistance value of the detector

500*b* (a signal from the detector 500*b*). This change in resistance value is inputted via the circuit board 600 into the control part of the electronic device, and the control part detects that the operation lever 100 has tilted in a direction including the component of the Y or Y' direction and also detects the amount of the tilt.

The detectors 500*a* and 500*b* are not limited to variable resistors. The detectors 500*a* and 500*b* may alternatively be constituted by, for example, electrostatic sensors, magnetic sensors, optical sensors, switches, or the like. The electrostatic sensor of the detector 500*a* may be configured to change a signal in accordance with a change in capacitance caused by a movement in the X-X' direction of a conductor, which may be provided in the at least one pivotable portion 230*a* or the slider 700*a*. The electrostatic sensor of the detector 500*b* may be configured to change a signal in accordance with a change in capacitance caused by a movement in the Y-Y' direction of a conductor, which may be provided in the at least one pivotable portion 230*b* or the slider 700*b*. The magnetic sensor of the detector 500*a* may be configured to change a signal in accordance with a change in magnetic flux density caused by a movement in the X-X' direction of a magnetic body, which may be provided in the at least one pivotable portion 230*a* and or the slider 700*a*. The magnetic sensor of the detector 500*b* may be configured to change a signal in accordance with a change in magnetic flux density caused by a movement in the Y-Y' direction of a magnetic body, which may be provided in the at least one pivotable portion 230*b* and or the slider 700*b*. The optical sensor of the detector 500*a* may be configured to optically detect a plurality of rotation angles in the X-X' direction of the at least one pivotable portion 230*a* or detect a plurality of positions to which the slider 700*a* has moved, and then output a signal corresponding to the detection. The optical sensor of the detector 500*b* may be configured to optically detect a plurality of rotation angles in the Y-Y' direction of the at least one pivotable portion 230*b* or detect a plurality of positions to which the slider 700*b* has moved, and then output a signal corresponding to the detection. The switch of the detector 500*a* may be configured to be electrically or mechanically turned on, in response to the pivoting of the at least one pivotable portion 230*a* or in response to the movement in the X-X' direction of the slider 700*a*. The switch of the detector 500*b* may be configured to be electrically or mechanically turned on, in response to the pivoting of the at least one pivotable portion 230*ba* or in response to the movement in the Y-Y' direction of the slider 700*b*. In short, the electrostatic sensor, the magnetic sensor, the optical sensor, or the switch of the detector 500*a* is configured to change or output a signal in accordance with the pivoting of the at least one pivotable portion 230*a* or in accordance with the movement of the slider 700*a*, while the electrostatic sensor, the magnetic sensor, the optical sensor, or the switch of the detector 500*b* is configured to change or output a signal in accordance with the pivoting of the at least one pivotable portion 230*b* or in accordance with the movement of the slider 700*b*. Where the electrostatic sensors, the magnetic sensors, the optical sensors, or the switches are configured to change or output signals in accordance with the pivoting of the at least one pivotable portion 230*a* and the at least one pivotable portion 230*b*, it is possible to omit the sliders 700*a* and 700*b* and the movement channels 340*a* and 340*b* of the housing 300.

The control part of the electronic device may have one of the following configurations (i) to (iii): (i) The control part is configured to receive signals from the electrostatic sensors or the magnetic sensors and, based on the changes of the received signals, detect that the operation lever 100 has tilted in a direction (i.e. a direction including the component of the X direction, a direction including the component of the X' direction, a direction including the component of the Y direction, or a direction including the component of the Y' direction) and also detect the amount of the tilt. (ii) The control part is configured to receive signals outputted by the optical sensors and, based on the received signals, detect that the operation lever 100 has tilted in a direction (i.e., a direction including the component of the X direction, a direction including the component of the X' direction, a direction including the component of the Y direction, or a direction including the component of the Y' direction) and also detect the amount of the tilt. (iii) The control part is configured to detect, based on which of the switches are turned on, that the operation lever 100 has tilted in a direction (i.e., a direction including the component of the X direction, a direction including the component of the X' direction, a direction including the component of the Y direction, or a direction including the component of the Y' direction).

The input device D may further include a restoration mechanism 800 for restoring the operation lever 100 in a tilted state to its neutral position. In this case, the interlocking member 200*a* may further include at least one abutment face 240*a*, and the interlocking member 200*b* may further include at least one abutment face 240*b*.

The at least one abutment face 240*a* is at least one face on the Z'-direction side of the main body 210*a* and the pivot shafts 220*a*. With the operation lever 100 located at the neutral position, the at least one abutment face 240*a* is substantially parallel to the circuit board 600. The at least one abutment face 240*b* is at least one face on the Z'-direction side of the main body 210*b* and the pivot shafts 220*b*. With the operation lever 100 located at the neutral position, the at least one abutment face 240*b* is located at the same height in the Z-Z' direction as the at least one abutment face 240*a*, and is substantially parallel to the circuit board 600.

The restoration mechanism 800 may include a ring 810 and urging member 820. The ring 810 is a generally circular ring plate and abuts the at least one abutment face 240*a* of the interlocking member 200*a* and the at least one abutment face 240*b* of the interlocking member 200*b*. The urging member 820 is an elastic body, such as a coil spring or a rubber member, and is arranged between the circuit board 600 and the ring 810.

Where the axial direction of the operation lever 100 at the neutral position coincides with the Z-Z' direction, the urging member 820 is configured to keep the at least one abutment face 240*a* and the at least one abutment face 240*b* substantially in parallel to the circuit board 600 by urging the abutment faces 240*a* and 240*b* via the ring 810. This makes it possible to keep the main body 210*a*, the pair of pivot shafts 220*a* of the interlocking member 200*a*, and the at least one pivotable portion 230*a* in their initial positions, and keep the main body 210*b*, the pair of pivot shafts 220*b*, and the at least one pivotable portion 230*b* of the interlocking member 200*b* in their initial positions. In accordance with this, the operation lever 100 is abutted by the first edge 212*a* and the second edge 213*a* of the first elongated hole 211*a* of the interlocking member 200*a* and by the first edge 212*b* and the second edge 213*b* of the second elongated hole 211*b* of the interlocking member 200*b*, so that the operation lever 100 is kept at the neutral position.

Where the axial direction of the operation lever 100 at the neutral position does not coincide with the Z-Z' direction, the urging member 820 may have a shape in which the end face on the Z-direction side is inclined. The urging member 820 may be configured to urge the at least one abutment face 240*a* and at least one abutment face 240*b* via the ring 810 so as to keep the abutment faces in an inclined state relative to the circuit board 600.

When the operation lever 100 is tilted from the neutral position in a direction including the component of the X direction, the component of the X' direction, the component of the Y direction, or the component of the Y' direction, the at least one abutment face 240*a* and/or the at least one abutment face 240*b* becomes inclined and the ring 810 becomes inclined so as to compress the urging member 820. When the operation lever 100 is released, the urging member 820 restores itself to restore, via the ring 810, the at least one abutment face 240*a* and/or the at least one abutment face 240*b* to the state (initial state) of being substantially parallel or inclined relative to the circuit board 600. As a result, the main body 210*a*, the pair of pivot shafts 220*a*, and the at least one pivotable portion 230*a* of the interlocking member 200*a* return to their initial positions, and/or the main body 210*b*, the pair of pivot shafts 220*b*, and the at least one pivotable portion 230*b* of the interlocking member 200*b* return to their initial positions, so that the operation lever 100 returns to the neutral position.

The ring 810 can be omitted. Where the ring 810 is omitted, the urging member 820 may be in direct abutment against the at least one abutment face 240*a* and the at least one abutment face 240*b*.

The linking structure L of the operation lever 100 and the input device D including the linking structure L as described above provide at least the following technical features and effects.

(First Technical Features and Effects) The linking structure L of the operation lever 100 imparts improved strength to the operation lever 100 being twisted in the circumferential direction for the following reasons. The cross-shaped portion of the operation lever 100 is received or fitted in the cross-shaped recess of the interlocking member 200*a*, or alternatively the X-shaped portion of the operation lever 100 is received or fitted in the X-shaped recess of the interlocking member 200*a*. This arrangement improves the strength of the operation lever 100 being twisted in the circumferential direction. In addition, the first elongated hole 211*a* of the interlocking member 200*a* is a blind hole which is closed on the Z'-direction side by the bottom 216*a*, and the bottom 216*a* is contiguous with the first edge 212*a*, the second edge 213*a*, the third edge 214*a*, and the fourth edge 215*a* of the first elongated hole 211*a*. With this arrangement, when the operation lever 100 is twisted in the circumferential direction and the first jut 120*a* and the second jut 120*b* of the operation lever 100 respectively press one and the other of the first edge 212*a* and the second edge 213*a*, the main body 210*a* of the interlocking member 200*a* will resist distortion.

Where the swingable portion 160 in addition to the cross-shaped portion of the operation lever 100 are received or fitted in the cross-shaped recess of the interlocking member 200*a*, or where the swingable portion 160 in addition to X-shaped portion of the operation lever 100 are received or fitted in the X-shaped recess of the interlocking member 200*a*, either of these arrangements imparts an improved strength to the operation lever 100 being twisted in the circumferential direction.

Where the swingable portion 160 is contiguous with the base 111, the first jut 120*a*, and the second jut 120*b*, the first jut 120*a* and the second jut 120*b* have improved twisting strength of in the circumferential direction.

Where the first ridge 141 is contiguous with the first jut 120*a* and the core 110, the first jut 120*a* has improved twisting strength in the circumferential direction. Where the second ridge 142 is contiguous with the second jut 120*b* and the core 110, the second jut 120*b* has improved twisting strength in the circumferential direction. Where the third ridge 143 is contiguous with the first rotation shaft 130*a* and the core 110, the first rotation shaft 130*a* has improved twisting strength in the circumferential direction. Where the fourth ridge 144 is contiguous with the second rotation shaft 130*b* and the core 110, the second rotation shaft 130*b* has improved twisting strength in the circumferential direction.

Where the or each reinforcing portion 150 is suspended between two adjacent ridges of the or each set, the two ridges have improved twisting strength. This results in that at least two of the first jut 120*a*, the second jut 120*b*, the first rotation shaft 130*a*, and the second rotation shaft 130*b*, which are contiguous with the two ridges, have improved twisting strength in the circumferential direction.

Where the main body 210*b* of the interlocking member 200*b* has the first to fourth protrusions 217*b*, the main body 210*b* has improved strength, resulting in that the interlocking member 200*b* has improved twisting strength in the circumferential direction.

(Second technical features and Effects) Where the first rotation shaft 130*a* and the second rotation shaft 130*b* of the operation lever 100 are rotatably supported from the Z-direction side by the first shaft supporting arm 218*a* and the second shaft supporting arm 218*a* of the interlocking member 200*a* in any of the manners described above, when the operation lever 100 is moved in the Z direction, a load in the Z direction is applied to the first shaft supporting arm 218*a* and the second shaft supporting arm 218*a* of the interlocking member 200*a* from the first rotation shaft 130*a* and the second rotation shaft 130*b* of the operation lever 100. Therefore, the load is unlikely to be applied to the interlocking member 200*b*. This arrangement can downsize the main body 210*b* of the interlocking member 200*b* in the Z-Z' direction.

Where the first guide 216*b* and the second guide 216*b* of the interlocking member 200*b* cover and guide the first shaft supporting arm 218*a* and the second shaft supporting arm 218*a* in any of the manners described above, even when the above-mentioned load in the Z direction is applied to the first shaft supporting arm 218*a* and the second shaft supporting arm 218*a*, the first guide 216*b* and the second guide 216*b* serve to suppress elastic deformation of the first shaft supporting arm 218*a* and the second shaft supporting arm 218*a* in the X and X' directions. This reduces the risk when the operation lever 100 is moved in the Z direction that the first shaft supporting arm 218*a* and the second shaft supporting arm 218*a* of the interlocking member 200*a* are elastically deformed in the X and X' directions such as to release the abutment of the first rotation shaft 130*a* and the second rotation shaft 130*b* of the operation lever 100 against the first shaft supporting arm 218*a* and the second shaft supporting arm 218*a*. Further, the load from the first rotation shaft 130*a* of the operation lever 100 is applied not only to the first shaft supporting arm 218*a* but also to the first guide 216*b*, in other words, the load is distributed between the first shaft supporting arm 218*a* and the first guide 216*b*. Likewise, the load from the second rotation shaft 130*b* of the operation lever 100 is applied not only to the second shaft supporting arm 218*a* but also to the second guide 216*b*, in other words, the load is distributed between the second shaft supporting arm 218*a* and the second guide 216*b*.

The above-mentioned input device D provide the following technical features and effects.

The cross-shaped portion of the operation lever 100 is received or fitted in the close-bottomed cross-shaped recess of the interlocking member 200*a*, or alternatively the X-shaped portion of the operation lever 100 is received or fitted in the close-bottomed X-shaped recess of the interlocking member 200*a*. This arrangement makes is possible to reduce the external dimensions of the first rotation shaft 130*a* and the second rotation shaft 130*b* of the operation lever 100, and thus possible to reduce the dimension in the Z-Z' direction of the input device D. Also in a case where the third ridge 143 is contiguous with the first rotation shaft 130*a* and the core 110, and where the fourth ridge 144 is contiguous with the second rotation shaft 130*b* and the core 110, it is possible to reduce the external dimensions of the first rotation shaft 130*a* and the second rotation shaft 130*b* of the operation lever 100, and thus possible to reduce the dimension in the Z-Z' direction of the input device D.

Further, where the first rotation shaft 130*a* and the second rotation shaft 130*b* of the operation lever 100 are rotatably supported from the Z-direction side by the first shaft supporting arm 218*a* and the second shaft supporting arm 218*a* of the interlocking member 200*a* in any of the manners described above, the load applied from the first rotation shaft 130*a* of the operation lever 100 is distributed between the first shaft supporting arm 218*a* and the first guide 216*b*, and the load applied from the second rotation shaft 130*b* of the operation lever 100 is distributed between the second shaft supporting arm 218*a* and the second guide 216*b*, this arrangement makes it possible to reduce the dimensions in the Z-Z' direction of the first shaft supporting arm 218*a* and the second shaft supporting arm 218*a*, and reduce the dimensions in the Z-Z' direction of the first guide 216*b* and the second guide 216*b*. This results in a reduced dimension in the Z-Z' direction of the input device D.

Where the pair of pivot shafts 220*a* of the interlocking member 200*a* is supported by the edges on the X- and X'-direction sides of the recesses of the pair of first supports 320*a*, the interlocking member 200*a* has improved twisting strength in the circumferential direction. Where the pair of pivot shafts 220*b* of the interlocking member 200*b* is supported by the edges on the Y- and Y'-direction sides of the recesses of the pair of second supports 320*b*, the interlocking member 200*b* has improved twisting strength in the circumferential direction. Improved twisting strength in the circumferential direction of the interlocking member 200*a* and the interlocking member 200*b* results in improved twisting strength in the circumferential direction of the input device D.

The linking structure of the operating lever and the input device of the invention are not limited to the embodiments described above, but may be modified as appropriate within the scope of the claims. Some examples of modification are described below.

The second interlocking member of the invention can be omitted. Where the second interlocking member of the invention is omitted, it is preferable to additionally omit the components associated with the second interlocking member, such as the second supports and the sliders. It is also preferable to modify the detectors 500*a* and 500*b* such that they are configured to directly detect the tilt of the operation lever 100. For example, the detectors 500*a* and 500*b* may be constituted by electrostatic sensors, magnetic sensors, or the like. The electrostatic sensor of the detector 500*a* may be configured to change a signal in accordance with a change in capacitance caused by movement of a conductor provided in the base 111 or the swingable portion 160 of the operation lever 100 in a direction including the component of the X or X' direction, while the electrostatic sensor of the detector 500*b* may be configured to change a signal in accordance with a change in capacitance caused by movement of the conductor in a direction including the component of the Y or Y' direction. The magnetic sensor of the detector 500*a* may be configured to change a signal in accordance with a change in magnetic flux density caused by movement of the magnetic material provided in the base 111 or the swingable portion 160 of the operation lever 100 in a direction including the component of the X or X' direction, while the magnetic sensor of the detector 500*b* may be configured to change a signal in accordance with a change in magnetic flux density caused by movement of the magnetic material in a direction including the component of the Y or Y' direction.

The linking structure of the operation lever of the invention may include a cover in place of the second interlocking member of any of the above aspects. This cover may have the same configuration as the main body of the second interlocking member of any of the above aspects. This cover may include, for example, the second elongated hole, the first edge on the one side in the first direction of the second elongated hole, the second edge on the other side in the first direction of the second elongated hole, the third edge on the one side in the second direction of the second elongated hole, and the fourth edge on the other side in the second direction of the second elongated hole of any of the above aspects. The cover may further include the first guide and the second guide of any of the above aspects. The cover may be fixed to the housing, the circuit board, the frame, and/or other component of the input device.

The operation lever of the invention may be configured to be tiltable only in the X-X' and Y-Y' directions, and none of oblique directions. In this case, the opening on the Z-direction side of the accommodating portion 310 of the housing 300 may be formed in a generally cross- or X-shape extending in the X-X' and Y-Y' directions to guide the operation lever.

The first direction of the invention may be any direction that coincides with the longitudinal direction of the first elongated hole of the first interlocking member of the invention. The second direction of the invention may be any direction that crosses the first direction. The third direction of the invention may be any direction that is substantially orthogonal to the first and second directions.

REFERENCE SIGNS LIST

- D: Input device
  - 100: Operation lever
    - 110: Core
      - 111: Base
    - 120*a*, 120*b*: First jut, second jut
    - 130*a*, 130*b*: First rotation shaft, second rotation shaft
      - 131*a*, 131*b*: First portion
      - 132*a*, 132*b*: Second portion
    - 141, 142, 143, 144: First, second, third, and fourth ridges
    - 150: Reinforcing portion
    - 160: Swingable portion
    - 170: Extension
  - 200*a*, 200*b*: First interlocking member, second interlocking member
    - 210*a*, 210*b*: Main body
      - 211*a*, 211*b*: First elongated hole, second elongated hole

212*a*, 212*b*: First edge
213*a*, 213*b*: Second edge
214*a*, 214*b*: Third edge
215*a*, 215*b*: Fourth edge
216*a*: Bottom
216*a*1: Bottom face
217*a*: First shaft hole, second shaft hole
217*a*1: First recess, second recess
217*a*2: First lateral hole, second lateral hole
218*a*: First shaft supporting arm, second shaft supporting arm
216*b*: First guide, second guide
217*b*: First to fourth protrusions
220*a*, 220*b*: Pivot shaft
230*a*, 230*b*: Pivotable portion
240*a*, 240*b*: Abutment face
300: Housing
400: Flame
500*a*, 500*b*: Detector (second detector, first detector)
600: Circuit board
700*a*, 700*b*: Slider
800: Restoration mechanism

What is claimed is:

1. A linking structure of an operation lever, the linking structure comprising:

a first interlocking member extending in a first direction and being pivotable in a second direction crossing the first direction, the first interlocking member including:

a first elongated hole being a blind hole extending in the first direction and opening to one side in a third direction, the third direction being substantially orthogonal to the first and second directions, a first edge of the first elongated hole on one side in the second direction, a second edge of the first elongated hole on the other side in the second direction, a third edge of the first elongated hole on one side in the first direction, a fourth edge of the first elongated hole on the other side in the first direction, a bottom closing the first elongated hole on the other side in the third direction and being contiguous with the first, second, third, and fourth edges, a first shaft hole in the first edge, the first shaft hole extending from the first elongated hole to the one side in the second direction and communicating with the first elongated hole, and a second shaft hole in the second edge, the second shaft hole extending from the first elongated hole to the other side in the second direction and communicating with the first elongated hole; and an operation lever linked to the first interlocking member such as to be tiltable in the first direction, the operation lever being configured to tilt in the second direction and to thereby pivot the first interlocking member to the same direction as the tilt of the operation lever, the operation lever including:

a base provided on one side in an axial direction of the operation lever and received in the first elongated hole, a first jut extending from the base to the one side in the first direction, a second jut extending from the base to the other side in the first direction, the first and second juts being swingably received in the first elongated hole and being in abutment with, or alternatively being opposed with a narrow clearance to, the first and second edges, a first rotation shaft extending from the base to the one side in the second direction and being supported in the first shaft hole such as to be rotatable in the first direction, and a second rotation shaft extending from the base to the other side in the second direction and being supported in the second shaft hole such as to be rotatable in the first direction.

2. The linking structure according to claim 1, wherein the bottom of the first interlocking member includes a bottom face of the first elongated hole, the operation lever further includes a swingable portion being provided on the base and projecting to the one side in the axial direction, and the swingable portion is swingably received in the first elongated hole, slidably abuts the bottom face of the first elongated hole, and is in abutment with, or opposed with a narrow clearance to, the first and second edges.

3. The linking structure according to claim 1, wherein the bottom of the first interlocking member includes a bottom face of the first elongated hole, the bottom face having an arc shape curving to the other side in the third direction in a cross section defined by the first and third directions, the operation lever further includes a swingable portion being provided on the base, the first jut, and the second jut and projecting to the one side in the axial direction, and the swingable portion is swingably received in the first elongated hole, slidably abuts the bottom face of the first elongated hole, and is in abutment with, or opposed with a narrow clearance to, the first and second edges.

4. The linking structure according to claim 1, wherein the first shaft hole of the first interlocking member includes a first recess, the first recess being provided in the first edge, extending from the first elongated hole to the one side in the second direction, communicating with the first elongated hole, and opening to the one side in the third direction, the second shaft hole of the first interlocking member includes a second recess, the second recess being provided in the second edge, extending from the first elongated hole to the other side in the second direction, communicating with the first elongated hole, and opening to the one side in the third direction, the first rotation shaft includes a first portion on the other side in the second direction and a second portion on the one side in the second-direction side relative to the first portion of the first rotation shaft, the first portion, or the first portion and the second portion, of the first rotation shaft is rotatably supported in the first recess, the second rotation shaft includes a first portion on the one side in the second direction and a second portion on the other side in the second-direction side relative to the first portion of the second rotation shaft, the first portion of the second rotation shaft, or the first portion and the second portion, of the second rotation shaft are rotatably supported in the second recess, the operation lever further includes a core and at least one ridge, the core extends in the axial direction of the operation lever and includes the base, the at least one ridge includes at least one of a first ridge, a second ridge, a third ridge, or a fourth ridge, the first ridge extends from the first jut to the other side in the axial direction and also extends from the core to the one side in the first direction, the second ridge extends from the second jut to the other side in the axial direction and also extends from the core to the other side in the first direction, the third ridge extends from the first portion, or the first portion and the second portion, of the first rotation shaft to the other side in the axial direction and also extends from the core to the one side in the second direction, and the fourth ridge extends from the first portion, or the first portion and the second portion, of the second rotation shaft to the other side in the axial direction and also extends from the core to the other side in the second direction.

5. The linking structure according to claim 4, wherein the at least one ridge includes at least one set of two adjacent ridges, and the at least one set is at least one of the following sets:

a set consisting of the first and third ridges adjacent to each other, a set consisting of the third and second ridges adjacent to each other, a set consisting of the second and fourth ridges adjacent to each other, or a set consisting of the fourth and first ridges adjacent to each other, the operation lever further includes at least one reinforcing portion, and the or each reinforcing portion is suspended between the two adjacent ridges of the or a corresponding set and located on the other side in the axial direction relative to the first interlocking member with a clearance therebetween.

6. The linking structure according to claim 5, wherein the first shaft hole of the first interlocking member further includes a first lateral hole, the first lateral hole extending from the first recess to the one side in the second direction and communicating with the first recess, the second shaft hole of the first interlocking member further includes a second lateral hole, the second lateral hole extending from the second recess to the other side in the second direction and communicating with the second recess, the first portion of the first rotation shaft is rotatably supported in the first recess, and the second portion of the first rotation shaft is rotatably supported in the first lateral hole, the first portion of the second rotation shaft is rotatably supported in the second recess, and the second portion of the second rotation shaft is rotatably supported in the second lateral hole, and the first interlocking member further includes:

a first shaft supporting arm being an edge portion of the first lateral hole and abutting the second portion of the first rotation shaft from the one side in the third direction; and a second shaft supporting arm being an edge portion of the second lateral hole and abutting the second portion of the second rotation shaft from the one side in the third direction.

7. The linking structure according to claim 5, further comprising a second interlocking member intersecting the first interlocking member on the one side in the third direction relative to the first interlocking member, wherein the second interlocking member includes:

a second elongated hole extending through the second interlocking member in the third direction and extending in the second direction, a first edge of the second elongated hole on the one side in the first direction, a second edge of the second elongated hole on the other side in the first direction, a third edge of the second elongated hole on the one side in the second direction, and a fourth edge of the second elongated hole on the other side in the second direction, the operation lever passes through the second elongated hole such as to be tiltable in the second direction inside the second elongated hole, the operation lever slidably abuts the first edge and the second edge of the second elongated hole, or alternatively is opposed with a narrow interstice to, and abuttable against, the first and second edges of the second elongated hole, the operation lever includes the first, second, third, and fourth ridges, the third edge of the second elongated hole includes a first protrusion protruding toward a gap between the first ridge and the third ridge, and a second protrusion protruding toward a gap between the third ridge and the second ridge, and the fourth edge of the second elongated hole includes a third protrusion protruding toward a gap between the second ridge and the fourth ridge, and a fourth protrusion protruding toward a gap between the fourth ridge and the first ridge.

8. The linking structure according to claim 4, wherein the first shaft hole of the first interlocking member further includes a first lateral hole, the first lateral hole extending from the first recess to the one side in the second direction and communicating with the first recess, the second shaft hole of the first interlocking member further includes a second lateral hole, the second lateral hole extending from the second recess to the other side in the second direction and communicating with the second recess, the first portion of the first rotation shaft is rotatably supported in the first recess, and the second portion of the first rotation shaft is rotatably supported in the first lateral hole, the first portion of the second rotation shaft is rotatably supported in the second recess, and the second portion of the second rotation shaft is rotatably supported in the second lateral hole, and the first interlocking member further includes:

a first shaft supporting arm being an edge portion of the first lateral hole and abutting the second portion of the first rotation shaft from the one side in the third direction; and a second shaft supporting arm being an edge portion of the second lateral hole and abutting the second portion of the second rotation shaft from the one side in the third direction.

9. The linking structure according to claim 8, wherein the first shaft supporting arm is elastically deformable to the one side in the second direction until the first shaft supporting arm is released from the abutment against the first rotation shaft, and the second shaft supporting arm is elastically deformable to the other side in the second direction until the second shaft supporting arm is released from the abutment against the second rotation shaft.

10. The linking structure according to claim 9, further comprising a second interlocking member intersecting the first interlocking member on the one side in the third direction relative to the first interlocking member, wherein the second interlocking member includes:

a second elongated hole extending through the second interlocking member in the third direction and extending in the second direction, a first edge of the second elongated hole on the one side in the first direction, a second edge of the second elongated hole on the other side in the first direction, a third edge of the second elongated hole on the one side in the second direction, a fourth edge of the second elongated hole on the other side in the second direction, a first guide provided on the third edge of the second elongated hole and located on a first oblique direction side, or on the one side in the second direction, relative to the first shaft supporting arm, wherein the first oblique direction includes components on the one side in the second direction and the one side in the third direction, and a second guide provided on the fourth edge of the second elongated hole and located on a second oblique direction side, or on the other side in the second direction, relative to the second shaft supporting arm, wherein the second oblique direction includes components on the other side in the second direction and the one side in the third direction, the operation lever passes through the second elongated hole such as to be tiltable in the second direction inside the second elongated hole, the operation lever slidably abuts the first edge and the second edge of the second elongated hole, or alternatively is opposed with a narrow interstice to, and abuttable against, the first and second edges of the second elongated hole, the first shaft supporting arm is swingably guided in the second direction by the first guide, and the second shaft supporting arm is swingably guided in the second direction by the second guide.

11. The linking structure according to claim 8, further comprising a second interlocking member intersecting the first interlocking member on the one side in the third direction relative to the first interlocking member, wherein the second interlocking member includes:

a second elongated hole extending through the second interlocking member in the third direction and extending in the second direction, a first edge of the second elongated hole on the one side in the first direction, a second edge of the second elongated hole on the other side in the first direction, a third edge of the second elongated hole on the one side in the second direction, a fourth edge of the second elongated hole on the other side in the second direction, a first guide provided on the third edge of the second elongated hole and located on a first oblique direction side, or on the one side in the second direction, relative to the first shaft supporting arm, wherein the first oblique direction includes components on the one side in the second direction and the one side in the third direction, and a second guide provided on the fourth edge of the second elongated hole and located on a second oblique direction side, or on the other side in the second direction, relative to the second shaft supporting arm, wherein the second oblique direction includes components on the other side in the second direction and the one side in the third direction, the operation lever passes through the second elongated hole such as to be tiltable in the second direction inside the second elongated hole, the operation lever slidably abuts the first edge and the second edge of the second elongated hole, or alternatively is opposed with a narrow interstice to, and abuttable against, the first and second edges of the second elongated hole, the first shaft supporting arm is swingably guided in the second direction by the first guide, and the second shaft supporting arm is swingably guided in the second direction by the second guide.

12. An input device comprising:

the linking structure according to claim 11;

a pair of first supports;

a pair of second supports;

a first detector; and a second detector, wherein the first interlocking member further includes a main body and a pair of pivot shafts, the pivot shafts extending from the main body respectively to the one and the other sides in the first direction and are rotatably supported by the corresponding first supports, the main body of the first interlocking member includes the first elongated hole, the first edge of the first elongated hole, the second edge of the first elongated hole, the third edge of the first elongated hole, the fourth edge of the first elongated hole, the bottom, the first shaft hole, the second shaft hole, the first shaft supporting arm, and the second shaft supporting arm, the second interlocking member further includes a main body and a pair of pivot shafts, the pivot shafts of the second interlocking member extending from the main body of the second interlocking member respectively to the one and the other sides in the second direction and are rotatably supported by the corresponding second supports, the main body of the second interlocking member includes the second elongated hole, the first edge of the second elongated hole, the second edge of the second elongated hole, the third edge of the second elongated hole, the fourth edge of the second elongated hole, the first guide, and the second guide, the operation lever is configured to tilt in the first direction with the first and second rotation shafts serving as a pivot and press the first or second edge of the second interlocking member, to cause the second interlocking member to pivot with the pivot shafts of the second interlocking member serving as the pivot, the operation lever is configured to tilt in the second direction together with the first interlocking member, with the pivot shafts of the first interlocking member serving as a pivot, to cause the first interlocking member to pivot with the pivot shafts of the first interlocking member serving as a pivot, the first detector is configured to detect a tilt of the operation lever in the first direction, and the second detector is configured to detect a tilt of the operation lever in the second direction.

13. The linking structure according to claim 1, wherein the first shaft hole of the first interlocking member includes a first lateral hole, the first lateral hole being provided in the first edge, extending from the first elongated hole to the one side in the second direction, and communicating with the first elongated hole, the second shaft hole of the first interlocking member includes a second lateral hole, the second lateral hole being provided in the second edge, extending from the first elongated hole to the other side in the second direction, and communicating with the first elongated hole, the first rotation shaft is rotatably supported in the first lateral hole, the second rotation shaft is rotatably supported in the second lateral hole, and the first interlocking member further includes:

a first shaft supporting arm being an edge portion of the first lateral hole and abutting the first rotation shaft from the one side in the third direction; and a second shaft supporting arm being an edge portion of the second lateral hole and abutting the second rotation shaft from the one side in the third direction.

14. The linking structure according to claim 13, further comprising a second interlocking member intersecting the first interlocking member on the one side in the third direction relative to the first interlocking member, wherein the second interlocking member includes:

a second elongated hole extending through the second interlocking member in the third direction and extending in the second direction, a first edge of the second elongated hole on the one side in the first direction, a second edge of the second elongated hole on the other side in the first direction, a third edge of the second elongated hole on the one side in the second direction, a fourth edge of the second elongated hole on the other side in the second direction, a first guide provided on the third edge of the second elongated hole and located on a first oblique direction side, or on the one side in the second direction, relative to the first shaft supporting arm, wherein the first oblique direction includes components on the one side in the second direction and the one side in the third direction, and a second guide provided on the fourth edge of the second elongated hole and located on a second oblique direction side, or on the other side in the second direction, relative to the second shaft supporting arm, wherein the second oblique direction includes components on the other side in the second direction and the one side in the third direction, the operation lever passes through the second elongated hole such as to be tiltable in the second direction inside the second elongated hole, the operation lever slidably abuts the first edge and the second edge of the second elongated hole, or alternatively is opposed with a narrow interstice to, and abuttable against, the first and second edges of the second elongated hole, the first shaft supporting arm is swingably guided in the second direction by the first guide, and the second shaft supporting arm is swingably guided in the second direction by the second guide.

15. An input device comprising:

the linking structure according to claim 14;

a pair of first supports;

a pair of second supports;

a first detector; and a second detector, wherein the first interlocking member further includes a main body and a pair of pivot shafts, the pivot shafts extending from the main body respectively to the one and the other sides in the first direction and are rotatably supported by the corresponding first supports, the main body of the first interlocking member includes the first elongated hole, the first edge of the first elongated hole, the second edge of the first elongated hole, the third edge of the first elongated hole, the fourth edge of the first elongated hole, the bottom, the first shaft hole, the second shaft hole, the first shaft supporting arm, and the second shaft supporting arm, the second interlocking member further includes a main body and a pair of pivot shafts, the pivot shafts of the second interlocking member extending from the main body of the second interlocking member respectively to the one and the other sides in the second direction and are rotatably supported by the corresponding second supports, the main body of the second interlocking member includes the second elongated hole, the first edge of the second elongated hole, the second edge of the second elongated hole, the third edge of the second elongated hole, the fourth edge of the second elongated hole, the first guide, and the second guide, the operation lever is configured to tilt in the first direction with the first and second rotation shafts serving as a pivot and press the first or second edge of the second interlocking member, to cause the second interlocking member to pivot with the pivot shafts of the second interlocking member serving as the pivot, the operation lever is configured to tilt in the second direction together with the first interlocking member, with the pivot shafts of the first interlocking member serving as a pivot, to cause the first interlocking member to pivot with the pivot shafts of the first interlocking member serving as a pivot, the first detector is configured to detect a tilt of the operation lever in the first direction, and the second detector is configured to detect a tilt of the operation lever in the second direction.

16. The linking structure according to claim 13, wherein the first shaft supporting arm is elastically deformable to the one side in the second direction until the first shaft supporting arm is released from the abutment against the first rotation shaft, and the second shaft supporting arm is elastically deformable to the other side in the second direction until the second shaft supporting arm is released from the abutment against the second rotation shaft.

17. The linking structure according to claim 1, wherein the operation lever is configured such that when the operation lever is twisted in a circumferential direction thereof, the first jut presses one of the first and second edges of the first elongated hole of the first interlocking member and the second jut presses the other of the first and second edges.

18. The linking structure according to claim 1, further comprising a second interlocking member intersecting the first interlocking member on the one side in the third direction relative to the first interlocking member, wherein the second interlocking member includes:

a second elongated hole extending through the second interlocking member in the third direction and extending in the second direction, a first edge of the second elongated hole on the one side in the first direction, a second edge of the second elongated hole on the other side in the first direction, a third edge of the second elongated hole on the one side in the second direction, and a fourth edge of the second elongated hole on the other side in the second direction, the operation lever passes through the second elongated hole such as to be tiltable in the second direction inside the second elongated hole, the operation lever slidably abuts the first edge and the second edge of the second elongated hole, or alternatively is opposed with a narrow interstice to, and abuttable against, the first and second edges of the second elongated hole.

19. An input device comprising:

the linking structure according to claim 18;

a pair of first supports;

a pair of second supports;

a first detector; and a second detector, wherein the first interlocking member further includes a main body and a pair of pivot shafts, the pivot shafts extending from the main body respectively to the one and the other sides in the first direction and are rotatably supported by the corresponding first supports, the main body of the first interlocking member includes the first elongated hole, the first edge of the first elongated hole, the second edge of the first elongated hole, the third edge of the first elongated hole, the fourth edge of the first elongated hole, the bottom, the first shaft hole, and the second shaft hole, the second interlocking member further includes a main body and a pair of pivot shafts, the pivot shafts of the second interlocking member extending from the main body of the second interlocking member respectively to the one and the other sides in the second direction and are rotatably supported by the corresponding second supports, the main body of the second interlocking member includes the second elongated hole, the first edge of the second elongated hole, the second edge of the second elongated hole, the third edge of the second elongated hole, and the fourth edge of the second elongated hole, the operation lever is configured to tilt in the first direction with the first and second rotation shafts serving as a pivot and press the first or second edge of the second interlocking member, to cause the second interlocking member to pivot with the pivot shafts of the second interlocking member serving as the pivot, the operation lever is configured to tilt in the second direction together with the first interlocking member, with the pivot shafts of the first interlocking member serving as a pivot, to cause the first interlocking member to pivot with the pivot shafts of the first interlocking member serving as a pivot, the first detector is configured to detect a tilt of the operation lever in the first direction, and the second detector is configured to detect a tilt of the operation lever in the second direction.

20. An input device comprising:

the linking structure according claim 1;

a pair of first supports;

a first detector; and a second detector, wherein the first interlocking member further includes a main body and a pair of pivot shafts, the pivot shafts extending from the main body respectively to the one and the other sides in the first direction and are rotatably supported by the corresponding first supports, the main body of the first interlocking member includes the first elongated hole, the first edge of the first elongated hole, the second edge of the first elongated hole, the third edge of the first elongated hole, the fourth edge of the first elongated hole, the bottom, the first shaft hole, and the second shaft hole, the operation lever is configured to tilt in the first direction with the first and second rotation shafts serving as a pivot, the operation lever is configured to tilt in the second direction together with the first interlocking member, with the pivot shafts of the first interlocking member serving as a pivot, to cause the first interlocking member to pivot with the pivot shafts serving as a pivot, the first detector is configured to detect a tilt of the operation lever in the first direction, and the second detector is configured to detect a tilt of the operation lever in the second direction.

* * * * *